US008919050B2

(12) United States Patent
Zimmerman et al.

(10) Patent No.: US 8,919,050 B2
(45) **Date of Patent: *Dec. 30, 2014**

(54) ANTI-TORSION CONSTRUCTION SYSTEM PROVIDING STRUCTURAL INTEGRITY AND SEISMIC RESISTANCE

(71) Applicant: SR Systems, LLC, Tuscaloosa, AL (US)

(72) Inventors: Steven Zimmerman, Linden, AL (US); Van T. Walworth, Lebanon, TN (US); Scott Drummond, Tuscaloosa, AL (US)

(73) Assignee: SR Systems, LLC, Tuscaloosa, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/850,984

(22) Filed: Mar. 26, 2013

(65) Prior Publication Data

US 2013/0247485 A1 Sep. 26, 2013

Related U.S. Application Data

(63) Continuation-in-part of application No. 13/613,441, filed on Sep. 13, 2012, now Pat. No. 8,726,581.

(60) Provisional application No. 61/685,793, filed on Mar. 26, 2012, provisional application No. 61/573,943, filed on Sep. 15, 2011.

(51) Int. Cl.
*E04B 7/04* (2006.01)

(Continued)

(52) U.S. Cl.
CPC ..... *E04H 9/00* (2013.01); *E04H 9/021* (2013.01); *E04H 9/14* (2013.01);

(Continued)

(58) Field of Classification Search
USPC ..... 52/698, 90.1, 92.1, 93.1, 92.2, 93.2, 52/293.3, 223.13, 167.1, 94, 302.1, 199, 52/202, 203, 284, 285.1, 282.5, 289, 715
See application file for complete search history.

(56) References Cited

U.S. PATENT DOCUMENTS 3,305,989 A * 2/1967 Scott ..... 52/295
3,668,828 A * 6/1972 Nicholas et al. ..... 52/92.1

(Continued)

FOREIGN PATENT DOCUMENTS

JP 04327627 A * 11/1992 ..... E04B 7/06
JP 06-306944 11/1994
JP 2009-293214 12/2009

OTHER PUBLICATIONS

International Search Report for PCT/US2012/055809 mailed Feb. 21, 2013.

(Continued)

*Primary Examiner* — Brent W Herring
(74) *Attorney, Agent, or Firm* — Harness, Dickey & Pierce, P.L.C.

(57) ABSTRACT

A system for constructing a residential or commercial structure and/or retrofitting an existing structure provides a series of construction components employed that cooperate with standard construction materials to enhance the building structural integrity when subjected to destructive wind forces, torsion forces, and seismic forces, such as those commonly associated with hurricanes and tornados. The resultant strength of the structure is increased beyond what the standard construction materials were capable of on their own. The components further cooperate with standard construction materials to provide a unitized system of structural integrity. The components further cooperate with a secondary water sealing ability to minimize and/or prevent influent water damage to the structure in the event that the primary sealing system is compromised.

19 Claims, 21 Drawing Sheets

(51) Int. Cl.

| | |
|---|---|
| ***E04H 9/00*** | (2006.01) |
| ***E04H 9/02*** | (2006.01) |
| ***E04H 9/14*** | (2006.01) |
| ***E02D 27/00*** | (2006.01) |
| ***E04B 1/26*** | (2006.01) |
| ***E04B 1/92*** | (2006.01) |
| ***E06C 1/34*** | (2006.01) |

(52) U.S. Cl.

CPC ..... *E02D 27/00* (2013.01); *E04B 1/26* (2013.01); *E04B 1/92* (2013.01); *E04B 7/045* (2013.01); *E06C 1/345* (2013.01); *E04H 9/027* (2013.01); *E04B 1/2608* (2013.01); *E04B 2001/2684* (2013.01); *E04B 2001/2696* (2013.01); *E04B 1/2604* (2013.01)

USPC ..... 52/92.2; 52/698; 52/293.3; 52/167.1; 52/285.1

(56) References Cited

U.S. PATENT DOCUMENTS

| | | | | | |
|---|---|---|---|---|---|
| 3,755,982 | A | * | 9/1973 | Schmidt | 52/295 |
| 3,785,108 | A | * | 1/1974 | Satchell | 52/645 |
| 3,902,280 | A | * | 9/1975 | Spoar et al. | 52/91.1 |
| 3,963,210 | A | * | 6/1976 | Macklin | 249/210 |
| 3,964,268 | A | * | 6/1976 | DiPeri | 62/121 |
| 4,073,103 | A | * | 2/1978 | McClure | 52/93.1 |
| 4,198,175 | A | * | 4/1980 | Knepp et al. | 403/191 |
| 4,321,776 | A | * | 3/1982 | Delight | 52/167.1 |
| 4,420,913 | A | * | 12/1983 | Long et al. | 52/57 |
| 4,455,792 | A | * | 6/1984 | Pasco | 52/93.2 |
| 4,872,298 | A | | 10/1989 | Klemic | |
| 4,875,314 | A | * | 10/1989 | Boilen | 52/167.1 |
| 4,890,436 | A | * | 1/1990 | Colonias | 52/643 |
| 4,982,545 | A | * | 1/1991 | Stromback | 52/639 |
| 5,050,364 | A | | 9/1991 | Johnson et al. | |
| 5,060,436 | A | | 10/1991 | Delgado | |
| 5,240,224 | A | | 8/1993 | Adams | |
| 5,317,850 | A | | 6/1994 | Colonias et al. | |
| 5,327,699 | A | * | 7/1994 | Khan et al. | 52/93.2 |
| 5,349,800 | A | * | 9/1994 | Peng | 52/506.06 |
| 5,384,993 | A | | 1/1995 | Phillips | |
| 5,388,804 | A | | 2/1995 | Cohen et al. | |
| 5,448,861 | A | * | 9/1995 | Lawson | 52/92.2 |
| 5,487,244 | A | * | 1/1996 | Hill | 52/202 |
| 5,491,935 | A | | 2/1996 | Coxum | |
| 5,699,639 | A | * | 12/1997 | Fernandez | 52/707 |
| 5,836,132 | A | | 11/1998 | Weathersby | |
| 5,881,501 | A | * | 3/1999 | Guffey et al. | 52/90.1 |
| 6,003,271 | A | * | 12/1999 | Boyer et al. | 52/79.5 |
| 6,014,843 | A | * | 1/2000 | Crumley et al. | 52/167.3 |
| 6,065,730 | A | | 5/2000 | Marks et al. | |
| 6,161,339 | A | * | 12/2000 | Cornett et al. | 52/23 |
| 6,256,960 | B1 | * | 7/2001 | Babcock et al. | 52/592.1 |
| 6,332,299 | B1 | * | 12/2001 | Stewart, III | 52/696 |
| 6,347,916 | B1 | | 2/2002 | Ramirez | |
| 6,367,205 | B2 | * | 4/2002 | Cornett, Sr. | 52/23 |
| 6,430,881 | B1 | * | 8/2002 | Daudet et al. | 52/92.2 |
| 6,691,488 | B2 | * | 2/2004 | Branson | 52/745.01 |
| 6,763,634 | B1 | * | 7/2004 | Thompson | 52/92.2 |
| 6,922,968 | B1 | | 8/2005 | Behlen | |
| 7,103,984 | B2 | | 9/2006 | Kastberg | |
| 7,140,155 | B1 | * | 11/2006 | Nasimov | 52/236.8 |
| 7,150,132 | B2 | * | 12/2006 | Commins | 52/293.3 |
| 7,174,689 | B2 | | 2/2007 | Alyea et al. | |
| 7,200,972 | B1 | * | 4/2007 | Freeman et al. | 52/641 |
| 7,398,620 | B1 | * | 7/2008 | Jones | 52/92.2 |
| 7,445,192 | B2 | | 11/2008 | Gridley et al. | |
| 7,448,172 | B1 | | 11/2008 | Knodel | |
| 7,788,878 | B1 | * | 9/2010 | diGirolamo et al. | 52/745.19 |
| 7,891,110 | B2 | | 2/2011 | Diaz | |
| 7,971,411 | B2 | * | 7/2011 | Commins | 52/745.21 |
| 8,046,966 | B2 | * | 11/2011 | Moore et al. | 52/506.06 |
| 8,065,846 | B2 | * | 11/2011 | McDonald et al. | 52/281 |
| 8,091,291 | B2 | * | 1/2012 | Ode | 52/93.1 |
| 2003/0024174 | A1 | | 2/2003 | Bonds et al. | |
| 2003/0182875 | A1 | * | 10/2003 | Hill | 52/92.1 |
| 2004/0049993 | A1 | * | 3/2004 | Saldana | 52/90.2 |
| 2005/0086888 | A1 | * | 4/2005 | Moore et al. | 52/506.06 |
| 2006/0254166 | A1 | * | 11/2006 | Michels et al. | 52/270 |
| 2006/0254167 | A1 | | 11/2006 | Antonic | |
| 2007/0094992 | A1 | * | 5/2007 | Antonic | 52/656.1 |
| 2010/0236158 | A1 | * | 9/2010 | Carbonaro | 52/92.1 |
| 2013/0067839 | A1 | * | 3/2013 | Zimmerman et al. | 52/293.3 |

OTHER PUBLICATIONS

Written Opinion of the International Searching Authority for PCT/US2012/055809 mailed Feb. 21, 2013.

International Search Report for PCT/US2013/033936 mailed Jul. 18, 2013.

Written Opinion of the International Searching Authority for PCT/US2013/033936 mailed Jul. 18, 2013.

* cited by examiner

ANTI-TORSION CONSTRUCTION SYSTEM PROVIDING STRUCTURAL INTEGRITY AND SEISMIC RESISTANCE

CROSS-REFERENCE TO RELATED APPLICATIONS

This application is a continuation-in-part of U.S. patent application Ser. No. 13/613,441, filed on Sep. 13, 2012, which claims the benefit of U.S. Provisional Application No. 61/685,793, filed on Mar. 26, 2012, which claims the benefit of U.S. Provisional Application No. 61/573,943, filed on Sep. 15, 2011. The entire disclosures of the above applications are incorporated herein by reference.

FIELD

The present disclosure relates to storm resistant components and residential or commercial structures enhanced to resist the damaging forces imposed by storm winds, storm rains, torsion forces, and seismic events.

BACKGROUND

This section provides background information related to the present disclosure which is not necessarily prior art.

It is well known that hurricanes and tornados create storm wind forces capable of damaging and/or destroying standard residential and commercial constructions. Wind storm forces are known to remove and/or compromise the primary sealing systems of shingles, roofing, siding, and veneers. Furthermore, wind storm forces are well known to lift off entire roof systems and blow down and/or suck out walls.

The winds associated with tornado and hurricane storms are known to include destructive straight line winds and other destructive forces that impose torsion forces upon a structure to effectively twist it apart. In addition, tornado and hurricane storms buffet structures with seismic type forces that effectively weaken the holding power of traditional fasteners like nails and screws. Furthermore, tornado storms include a vortex, and sometimes several smaller vortices inside of a large vortex, which impose a spiraling shell of wind capable of imposing an effective dynamic wall of wind known to apply impact forces to a structure, capable of effectively bumping and/or knocking it down, not just blowing it down.

Observations of tornado storm events suggest that a vortex travels while spinning in an unorthodox, unpredictable, and indefinable warble-like pattern and/or path. The warble-like pattern of movement relative to the ground gives the spinning wind wall impact like force acting on a structure as it whips around with sudden changes of direction. As a result, frame-type structures usually suffer significant damage from direct hits by a tornado, regardless of the size or classification of the storm.

In addition, wind storm forces are well known to impose substantial blowing rain events which become influent to structures even before the construction components fail and/or are compromised. Beyond the obvious influent opportunities resulting from broken windows and/or other compromised construction components, wind storm events are known to blow rain into and through functioning vents of an intact roof system, thus creating water damage even though little or no actual structural damage occurs.

In addition to wind and rain hazards, severe wind events impose seismic forces upon buildings, not unlike the seismic forces imposed by an earthquake. One of the reasons that frame-type buildings seem to explode apart is partly because the fasteners, which are traditionally nails and/or screws, significantly weakened lose their holding power when subjected to seismic forces. As a result, once the holding power of traditional nails and screws is compromised, subsequent applied forces of wind, rain, torsion, and/or seismic in nature, can have significant destructive impact upon a structure.

There are numerous representatives of known art resident in the patent records that deal with various hurricane or tornado storm wind forces by claiming use of any one of several strengthening components. However, one of the major problems with all of the known examples is that they do not lend themselves to our do-it-yourself culture and do not lend themselves to be cost effective for the mass consumption public at large.

Another problem with known art examples is that none of these patent records for structural strengthening systems includes a means to provide a secondary sealing system for the structure in the event the primary sealing system of shingles and/or siding of the structure are compromised.

Another problem with the known art examples is that none of these patent records for structural strengthening systems includes a means to provide anti-torsion and seismic resistance to the construction system by unitizing the basic frame-type construction elements.

There are some references of known art in the patent records related to systems that minimize water influent damage from wind storms but, once again, none of these examples lend themselves to our do-it-yourself culture and do not lend themselves to be cost effective for the mass consumption public at large. In addition, none of the known examples provide any strengthening enhancements to improve the structural integrity of frame-type construction to resist the destructive torsion forces imposed by wind storms or the destructive seismic forces imposed by wind storms and other seismic events. Furthermore, none of these prior art sealing systems provides a secondary sealing system in the event that the primary sealing system is compromised.

SUMMARY

This section provides a general summary of the disclosure, and is not a comprehensive disclosure of its full scope or all of its features.

The subject invention overcomes well-known problems in such a way that those skilled in the art will readily recognize and appreciate. Furthermore, the present disclosure provides features and capabilities for many other applications beyond the preferred embodiments disclosed, which those skilled in the art will readily recognize also embody the spirit of the subject invention.

One preferred embodiment of the subject invention relates to a typical residential stick-built or prefabricated home construction which is enhanced and substantially strengthened in specific areas of the structure to better withstand the destructive wind forces of hurricanes and tornados, as imposed in the form of straight line winds, torsion forces, and/or seismic forces. One preferred embodiment also provides a secondary watertight seal which is utilized to maintain a reasonable barrier from influent storm water and blowing rain in the event that the primary water barrier via the shingles and/or siding is compromised during the storm.

It is understood that the secondary water seal requires that the structure must maintain a reasonable structural integrity; therefore, a series of structural enhancements are employed for this purpose and to further maintain structural integrity against storm wind forces. The structural enhancement system is comprised of several subsystems which all work together to collectively enhance the structural integrity of the structure. These subsystems include but are not limited to the following:

Anchoring System
Wall Reinforcement System
Rafter/Joist Tie-Down System
Wind-Beam System
Diaphragm Reinforcement System
Wall Sheeting System
Roof Decking System
Venting System
Window/Door Protective Seal System
Safe Room System Those skilled in the art will readily understand that while many typical structures will require all of the listed subsystems to enhance the structure adequately against severe storm winds, some complex structures may require additional specialized subsystems, while less complex structures may only require a partial list of the subsystems. A brief description of each subsystem follows.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
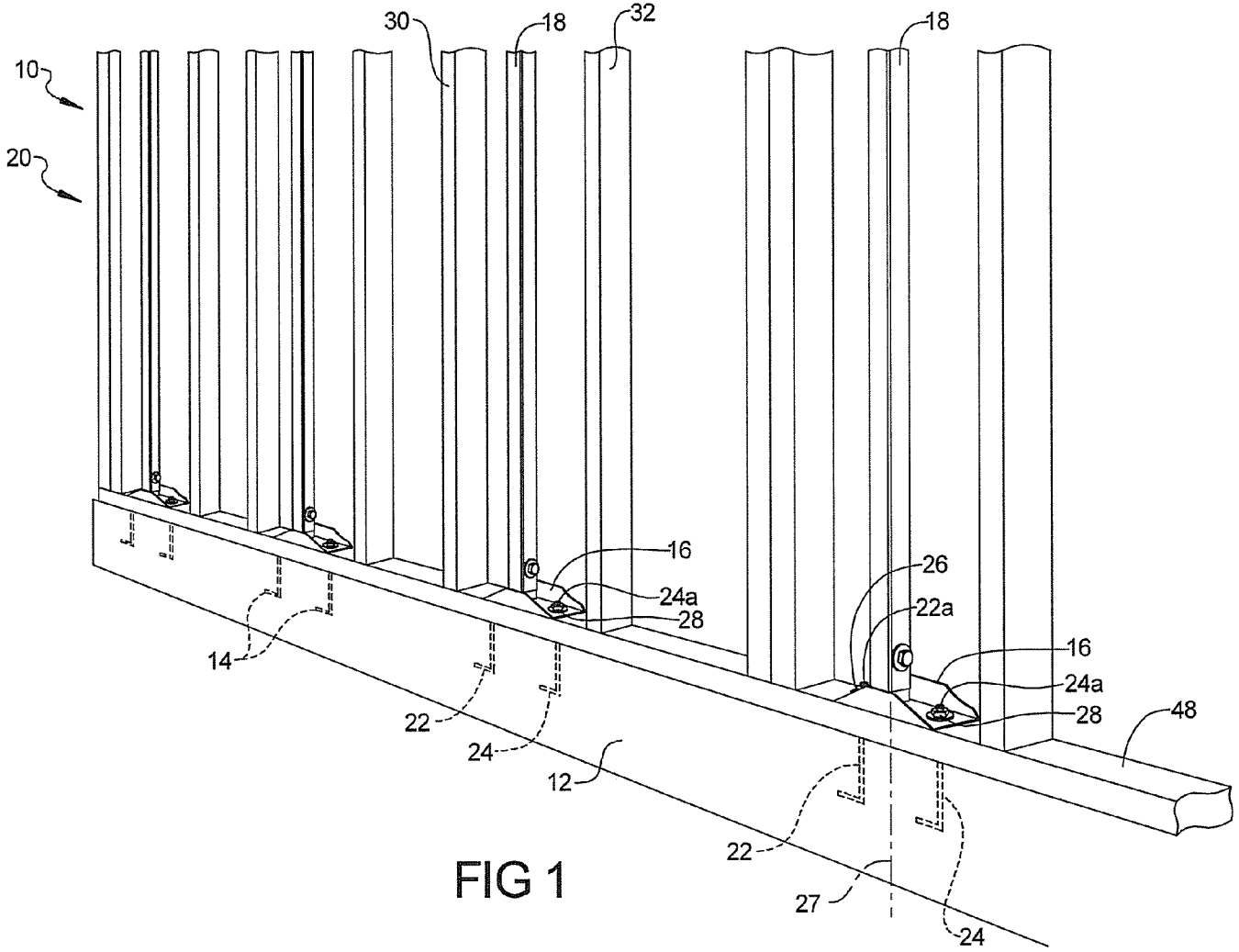
FIG. 1 is a front left perspective view of a building structure anchoring system.

Referring to FIG. 1, an anchoring system 10 connected to a typical slab 12 defining a foundation construction includes anchor bolt sets 14 at least partially embedded in the slab 12 connected to a wall reinforcement system having multiple anchor brackets 16, and multiple specialized structural members or structural columns 18 connected to the anchor brackets 16. The anchoring system 10 as defined by the subject invention is a subsystem that anchors a building structure 20 to the slab 12 or other foundational elements. One preferred embodiment enhancement system provides specialized first and second anchor bolts 22, 24 to provide proper placement and anchoring means to cooperate with other structural enhancement components. An alternative preferred embodiment employs standard anchor bolt components. Whether using specialized anchor bolts 22, 24 or standard anchor bolts, the present disclosure requires that appropriate anchor means include anchor bolt nuts 26, 28 connecting to freely extending portions 22*a*, 24*a* of the specialized anchor bolts 22, 24 to the anchor brackets 16, which are positioned between sequentially spaced apart members such as studs 30, 32, are employed with new construction slabs 12 being poured, preexisting slabs, and for construction or retrofit of structures on top of crawl space walls or basement walls. The freely extending portions 22*a*, 24*a* of the anchor bolts 22, 24 for each anchor bracket 16 are oppositely positioned with respect to a longitudinal axis 27 of the structural column 18 connected to each anchor bracket 16 to resist axial rotation/twisting of the structural columns 18 and thereby to resist axial rotation/twisting of the studs 30, 32. The present disclosure unitizes the anchoring system 10 to cooperate and integrate the respective features of a wall reinforcement system 34 (shown and described in reference to FIGS. 2-3) and/or a safe room system 72 (shown and described in reference to FIG. 13).

Referring to FIG. 2 and again to FIG. 1, the wall reinforcement system 34 as defined by the present disclosure is a subsystem which integrates into a typical stud type wall construction 36 of building structure 20 to provide significant enhanced compression and tension strength to the wall construction 36. A typical wood or metal stud built wall 38 having sequentially spaced studs 30, 32 may have appropriate compressive strength but it has very little tension strength and therefore is susceptible to lift forces during storm winds. In addition, the wall reinforcement system 34 of the subject invention provides resistance to forces that result in torsion and/or rhombus conditions. The specialized structural member or structural column 18 is a metal tube installed in the stud wall 38 at intervals between adjacent ones of the studs along the wall 38 and/or at wall corners 40 such that the structural member 18 is substantially stronger than the typical stud wall components, such as wood or metal studs, and is capable of being firmly and strongly attached to the anchoring system 10 described in reference to FIG. 1. According to one embodiment, sheeting 42 is bolted to the specialized wall member 18 which is anchored to the foundation slab 12 and bolted through a double top plate 44 to the rafter/joist tie-down system 46. The wall reinforcement system 34 provides a strong and solid connection from a bottom plate 48 of the stud wall 38 all the way to the top plate 44 of the stud wall 38, where it is again firmly and solidly attached and terminated.

Figure 2:
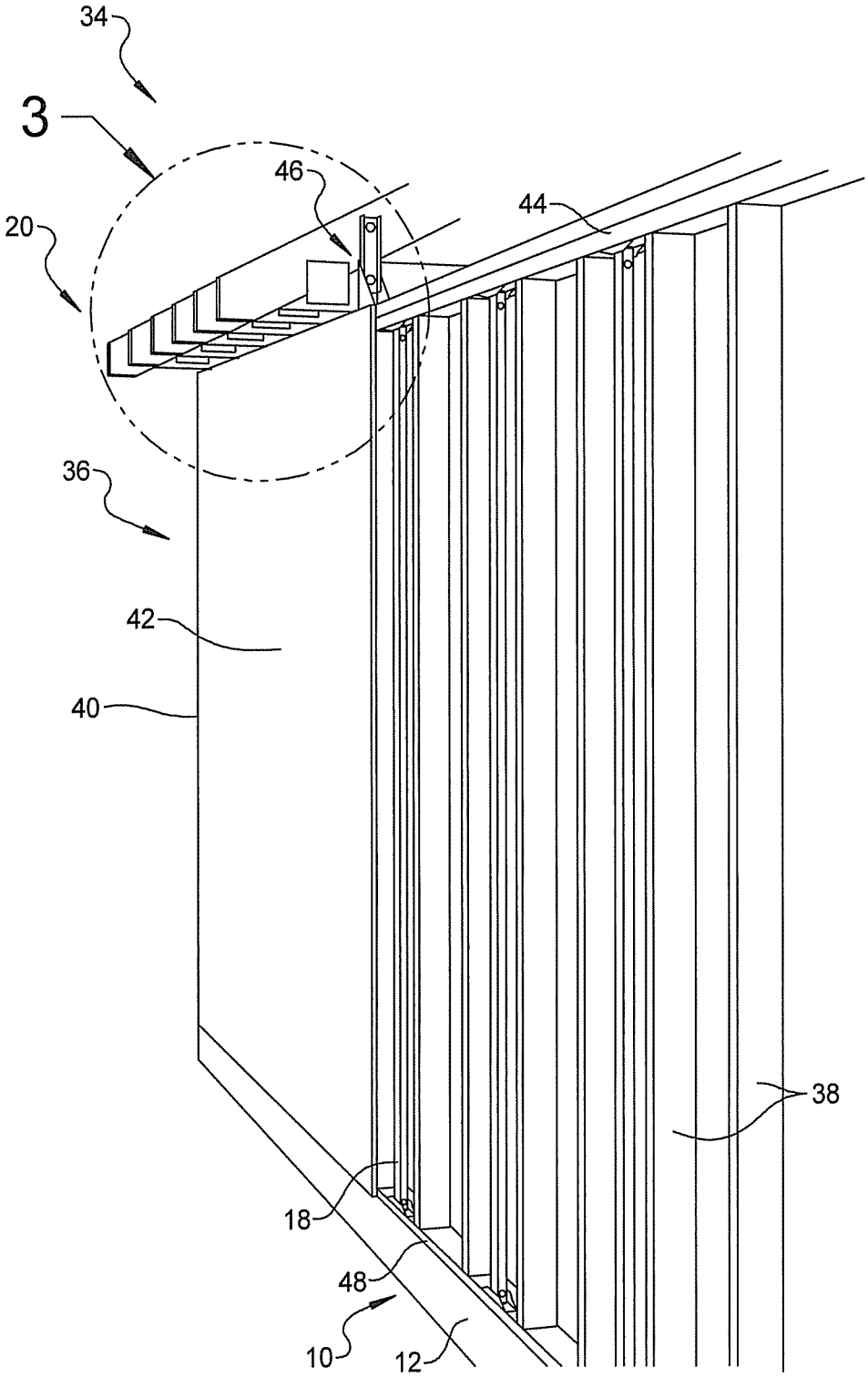
FIG. 2 is a front left perspective view of the building structure of FIG. 1, further including a wall reinforcement system.

Referring to FIG. 3 and again to FIGS. 1-2, according to one embodiment, the structural column 18 is bolted through the top plate 44 of the wall 38 to roof elements 50, 52, such as the upper and lower chords of a roof truss or the rafters and ceiling joists of a common roof system. The wall reinforcement system 34 ties together the roof components, the wall components, and the foundation using the structural columns 18 fastened/bolted at opposite ends to building structure.

Figure 3:
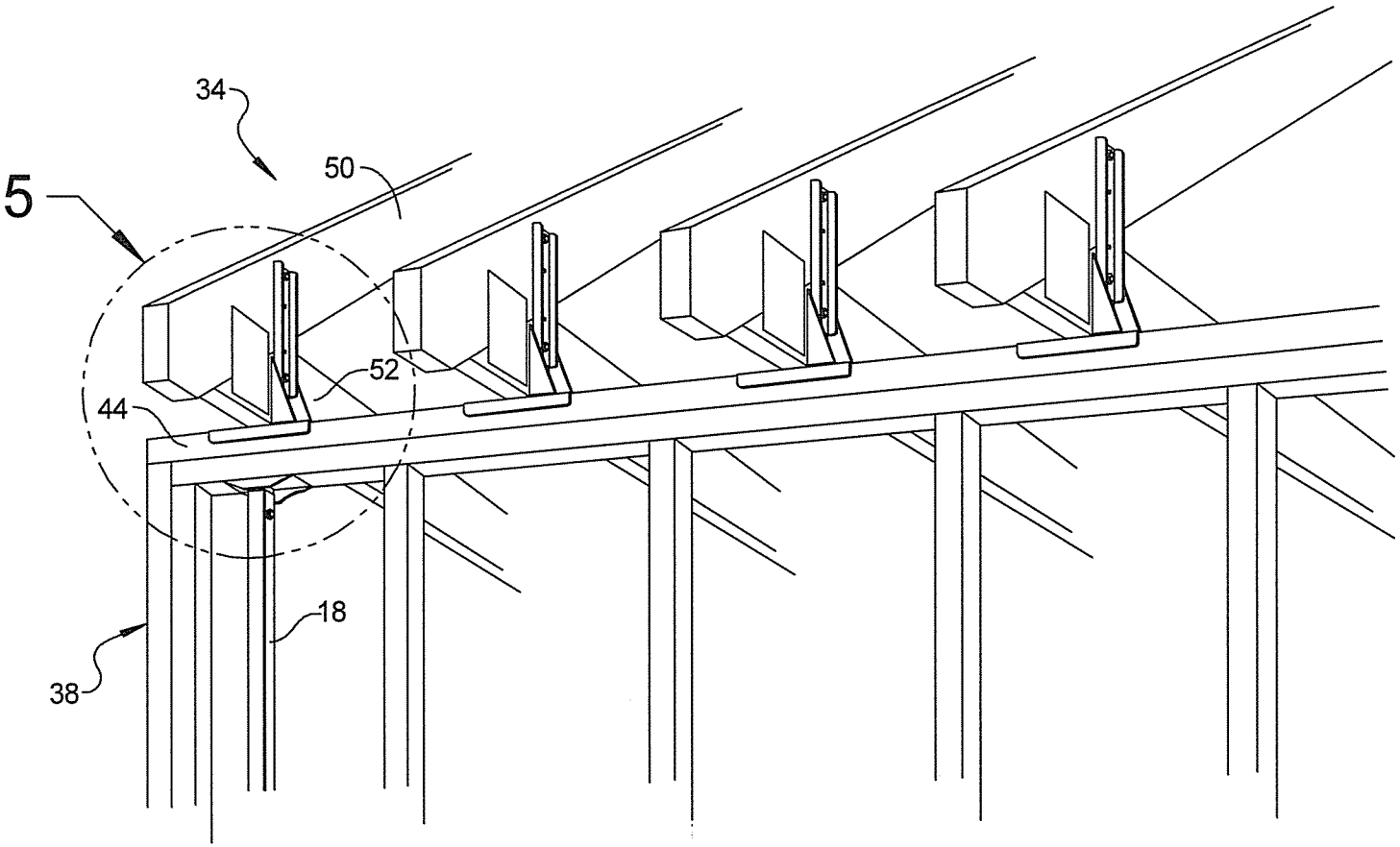
FIG. 3 is a front left perspective view of area 3 of FIG. 2.
Figure 4:
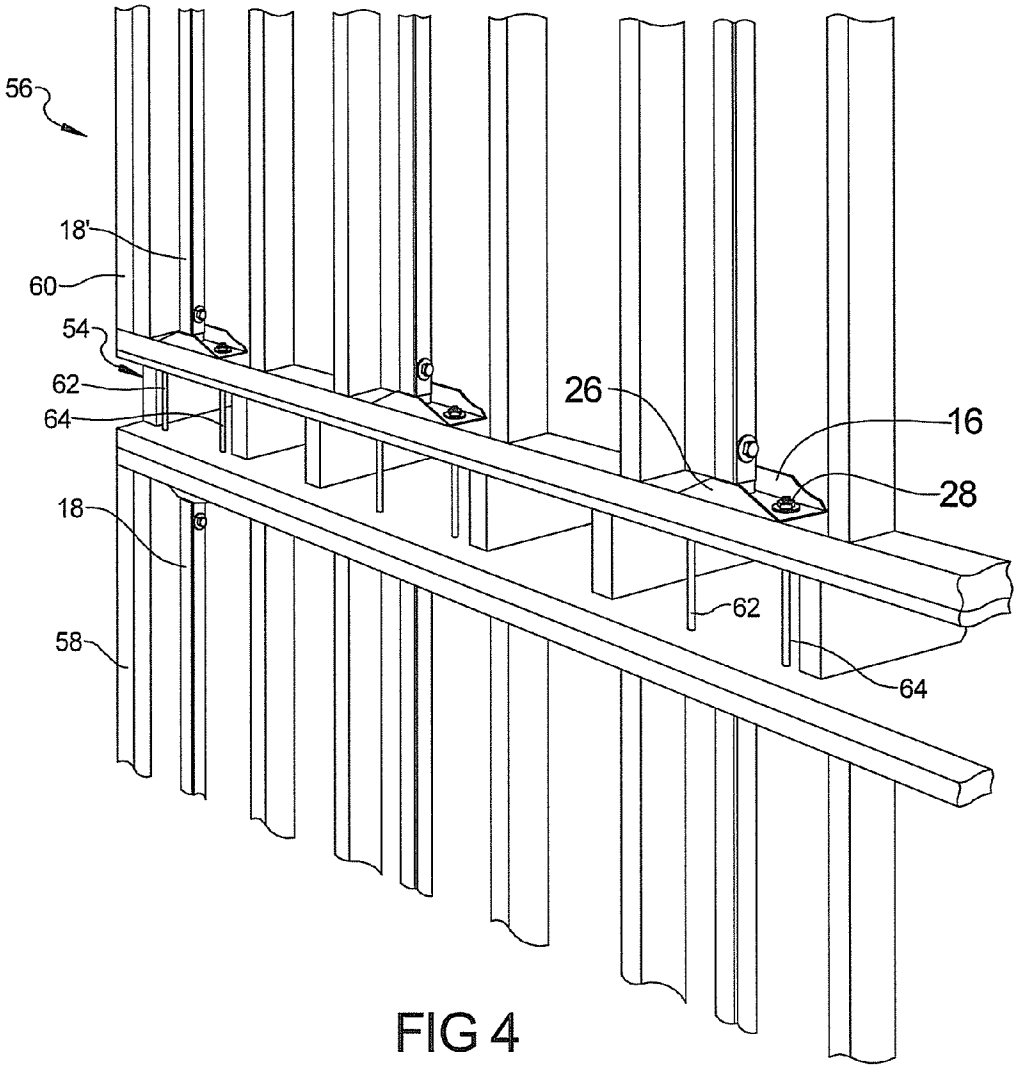
FIG. 4 is a front left perspective view of a portion of the building structure of FIG. 1, modified to show upper and lower structure joined by floor joists.
Figure 7:
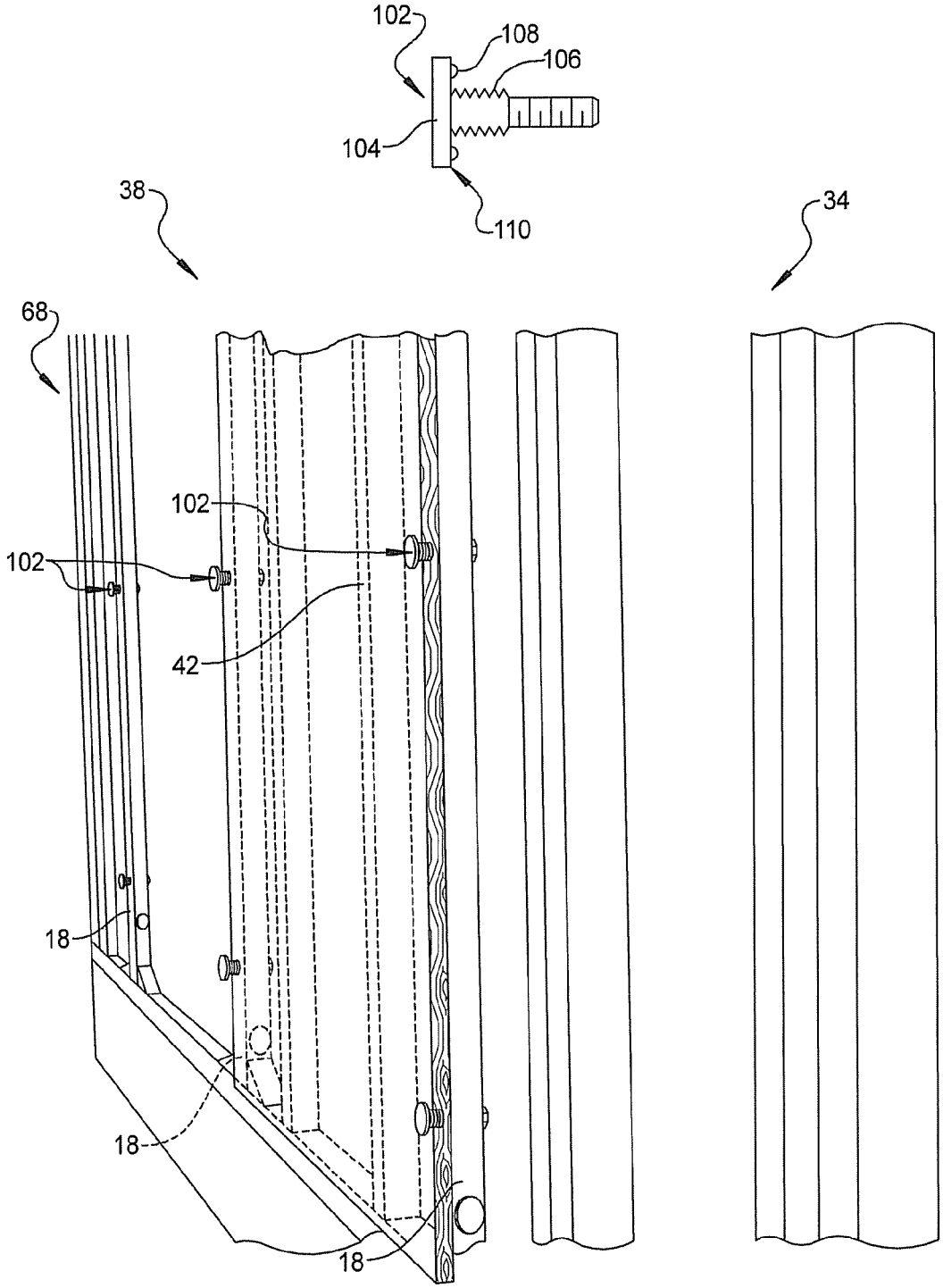
FIG. 7 is a front left perspective view of the building structure similar to FIG. 2, further including a wall sheeting system.

Referring to FIG. 4 and again to FIGS. 1-3, the present disclosure also applies to multi-story structures by employing bolted connections across a floor joist construction 54 of a multi-story wall construction 56 wherein wall reinforcement columns 18, 18' on lower and upper floors 58, 60 are bridged and connected via bolted connectors 62, 64 across the floor joist construction 54. The present disclosure effectively unitizes the entire wall construction 56 by employing the wall reinforcement system 34 to cooperate and integrate the respective features of the anchoring system 10 and a rafter/joist tie-down system 66 (which is shown and described in reference to FIG. 5) and with a wall sheeting system 68 (which is shown and described in reference to FIG. 7) and with a diaphragm reinforcement system 70 (which is shown and described in reference to FIG. 10) and/or a safe room system 72 (which is shown and described in reference to FIG. 13).

Referring to FIG. 5 and again to FIGS. 1-4, the rafter/joist tie-down system 66 as defined by the subject invention is a firmly and strongly attached means to effectively connect the upper chords or rafters 50 and the lower chords or ceiling joists 52 to the top plate 44 of the stud wall 38 and more importantly directly to the wall reinforcement system 34. The rafter/joist tie-down system 66 also provides a strong connection means at each crossing point on outside walls and inside walls for every rafter 50 and/or joist 52 whether it is connected directly to or indirectly connected to a member 18 of the wall reinforcement system 34.

Figure 5:
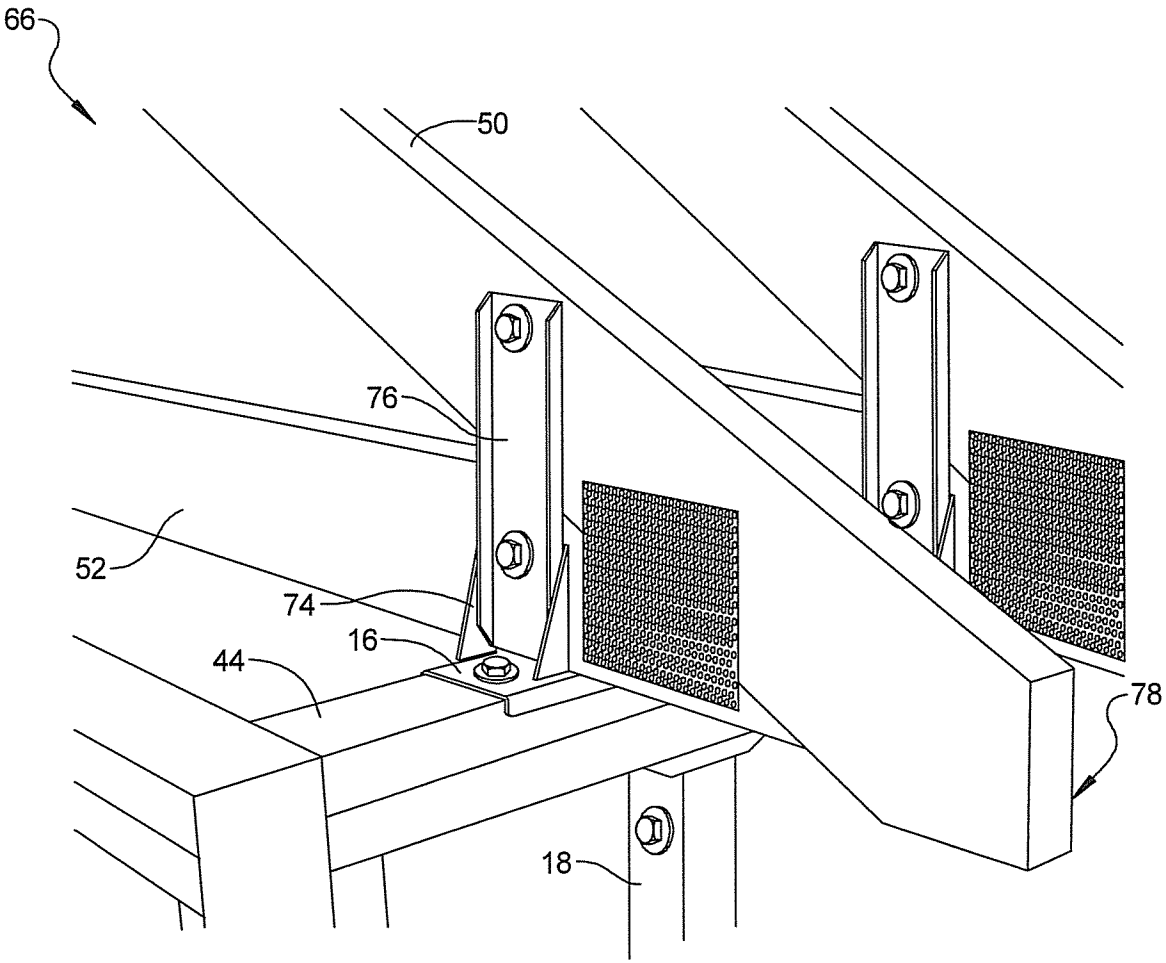
FIG. 5 is a front right perspective view of area 5 of FIG. 3.

Referring to FIG. 5, each wall reinforcement member or structural column 18 is bolted to a rafter tie-down connector 74. A typical truss example is provided wherein a rafter tie-down extension 76 spans between the lower chord 52 and upper chord 50 of a truss 78. The rafter/joist tie-down system 66 also resists rafters 50 and/or joists 52 from being compromised due to lift forces generated by storm wind forces. The rafter/joist tie-down system 66 also resists rafters 50 and/or joists 52 from being easily twisted due to torsion forces and/or rhombus forces, which enhances the relative strength of the structure to resist shear forces acting upon the structure as a result of strong straight line winds or tornadic vortexes. Testing and research has demonstrated and taught that the best roof pitch for storm wind resistance is about a 15-degree angle off a horizontal plane; that a hip roof construction is more storm-worthy than a gable end construction; and further that less roof overhang is better than long extended roof overhang construction.

Figure 8:
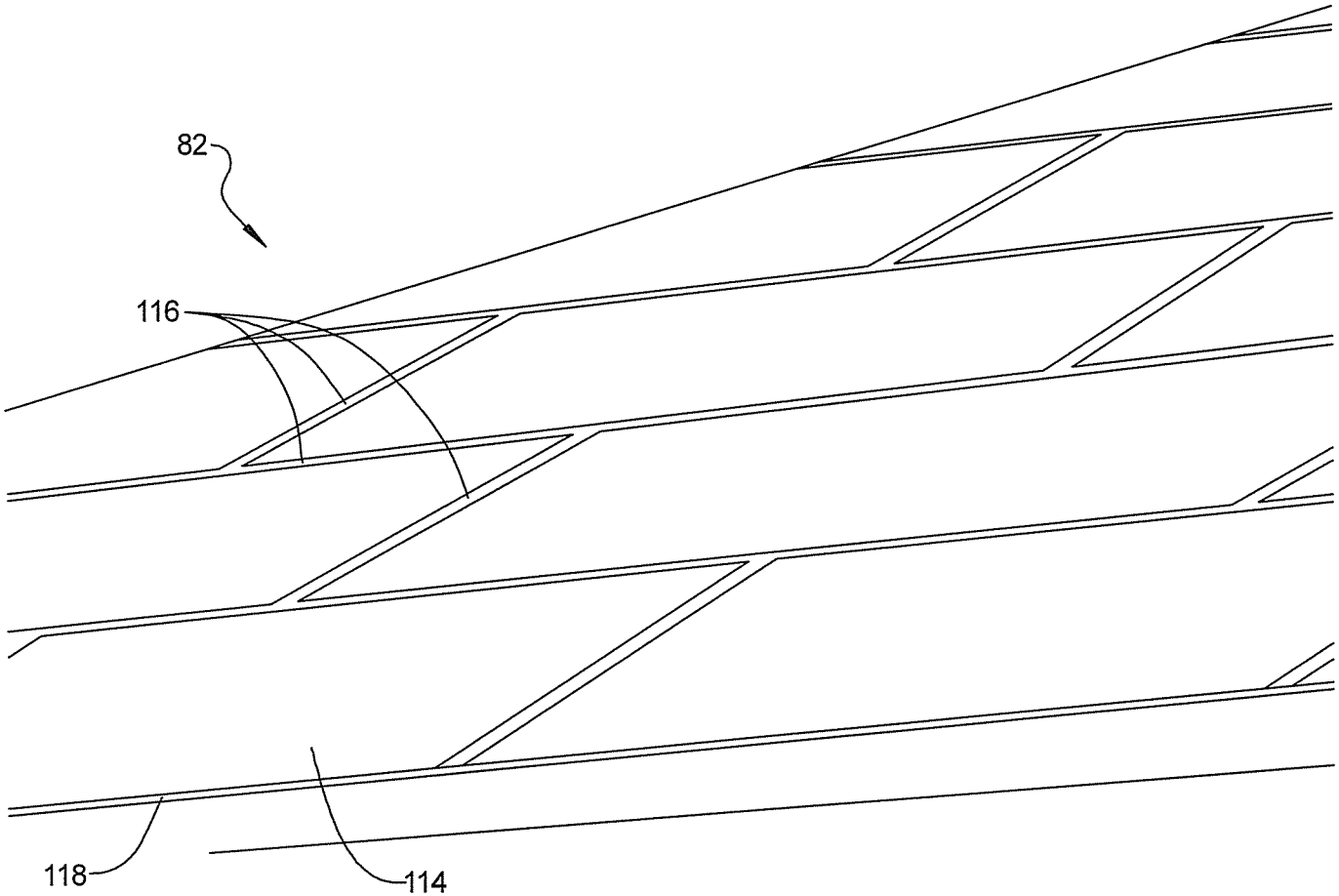
FIG. 8 is a front left perspective view of a roof decking system.

The present disclosure and rafter/joist tie-down system 66 is able to enhance standard roof construction that exploits the known research and yet still provides some enhancements for other roof constructions that do not conform to the prior art research for best storm construction. The subject invention effectively unitizes the entire roof system by employing the features of the rafter/joist tie-down system 66 to cooperate and integrate with the respective features of the wall reinforcement system 34 and a wind-beam system 80 (shown and described in reference to FIG. 6), a roof decking system 82 (shown and described in reference to FIG. 8), a venting system 84 (shown and described in reference to FIG. 11), the diaphragm reinforcement system 70, and/or the safe room system 72.

Figure 6:
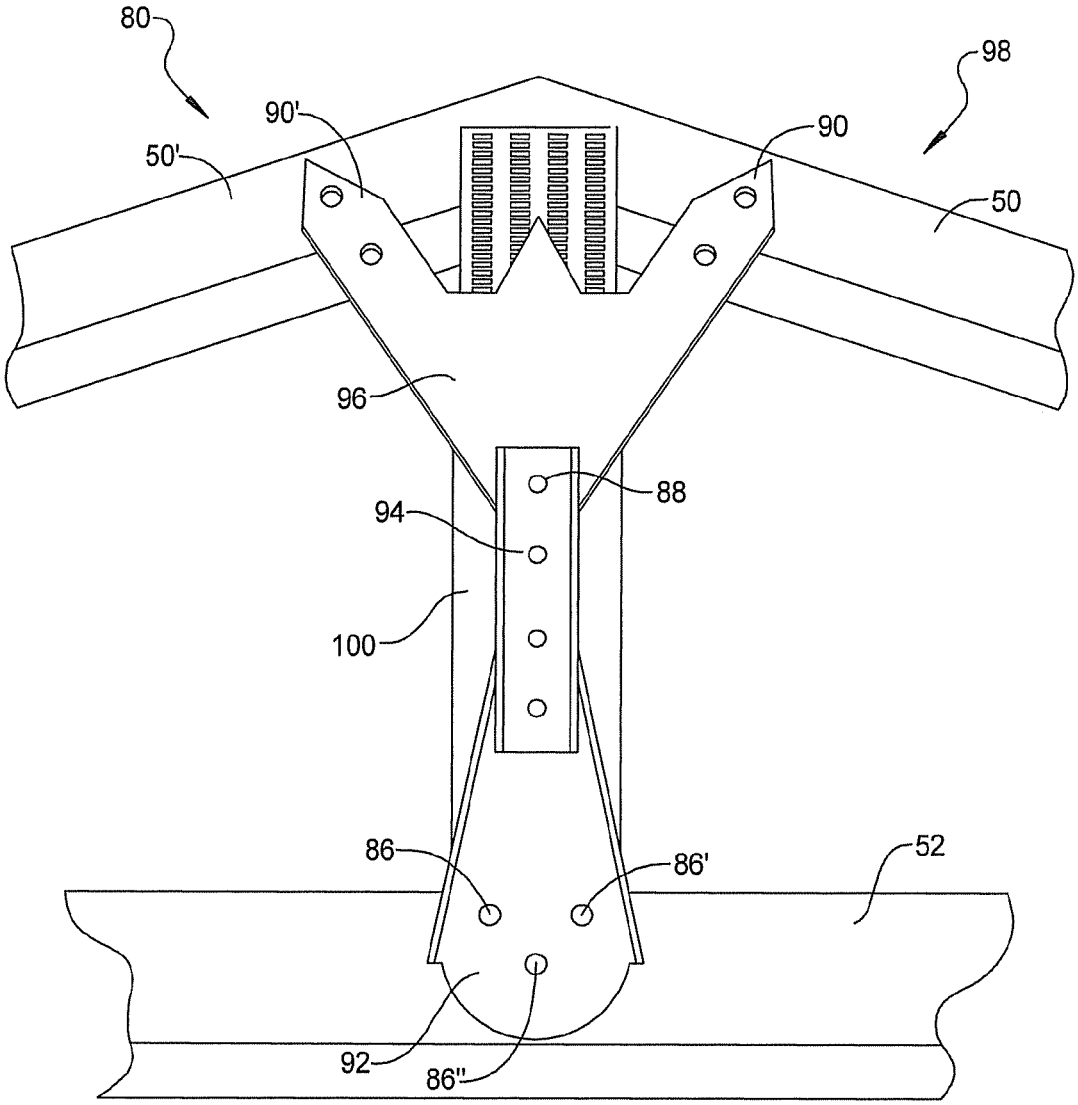
FIG. 6 is a bottom front perspective view of a truss assembly.

Referring to FIG. 6, the wind-beam system 80 as defined by the subject invention is a series of reinforcement components employed at the connections of rafters 50, 50' and trusses 52 to enhance the structural integrity of the rafters and trusses. A typical truss 52 is enhanced at connection points 86, 88, 90 with wind-beam components including in several preferred embodiments a wind-beam chord connector 92, a wind-beam extension 94, and a wind-beam ridge connector 96. The wind-beam chord connector 92 is a metal member connecting the joist 52 to an angularly oriented joining member, which according to several aspects is a transversely oriented center gable end stud or kingpost 100. The wind-beam ridge connector 96 is a metal plate connecting the kingpost 100 to both the upper chords or rafters 50, 50'. The wind-beam extension 94 is a metal U-channel that can be used to connect the wind-beam chord connector 92 to the wind-beam ridge connector 96. Typical construction techniques for rafters 50 and trusses 52 include nail plates and individual nails at connection points. During storm wind conditions, one side of the roof is considered the windward side if the wind is blowing directly toward that roof section. As a result, the forces acting upon the roof place it in compression. In contrast, the opposite side of the roof is referred to the leeward side and creates lifting force acting on this portion of the roof. As a result, the combination of one side of the roof pressing down simultaneously as the other side is trying to lift off invites significant structural damage at relatively low force values.

The wind-beam system 80 effectively reinforces roof rafters 52 and/or trusses 98 together with strong and securely fastened members such as the wind-beam chord connector 92, wind-beam extension 94, and wind-beam ridge connector 96, which effectively unitizes the entire roof system together to act more as a unit than as individual roof components. The wind-beam system 80 works on traditional rafter systems and/or traditional truss systems. Those skilled in the art will appreciate that the steeper the roof pitch, the greater the lift forces on the leeward side, and thus the stronger the wind-beam system 80 effectively needs to be, all things being equal. The subject invention effectively unitizes the entire roof system by employing the features of the wind-beam system 80 to cooperate and integrate with the respective features of the rafter/joist tie-down system 66 and the roof decking system 82, the venting system 84, the diaphragm reinforcement system 70, and/or the safe room system 72.

Referring to FIG. 7 and again to FIGS. 1-6, the wall sheeting system 68 as defined by the subject invention provides an improved method of covering and sealing the exterior walls 38 of the structure prior to applying additional façade or other cosmetic coverings such as vinyl siding, brick, et cetera. Wall sheeting 42, such as plywood, is bolted to the wall reinforcement structural columns 18 using bolts 102. The wall sheeting system 68 provides an improved fastening method by bolting the sheeting 42 to the wall reinforcement system 34, which ensures that the sheeting 42 will remain securely in place when the structure is exposed to storm wind forces. Because the wall sheeting system 68 stays securely in place during storm wind forces, it is enabled to provide a secondary water seal for the wall 38 to resist rain and blowing rain in the event that the primary covering and weather seal façade is compromised and/or lost during storm winds subjected upon the structure. One preferred embodiment of the subject invention includes a specialized bolted fastener 102 featuring an enlarged flat head 104 with barbs 106 which seat into the sheeting 42 and includes a sealing ring rib 108 on the underside 110 of the enlarged head 104 to securely and firmly hold and maintain a watertight seal. In appropriate applications, the wall sheeting system 68 is incorporated into the safe room system 72 such that requirements for resisting penetrations from airborne debris are accomplished. The subject invention effectively unitizes the entire wall construction by employing the features of the wall sheeting system 68 to cooperate and integrate with the respective features of the wall reinforcement system 34 and a window/door protective seal system 112 (shown and described with respect to FIG. 12), and the safe room system 72.

Referring to FIG. 8 and again to FIGS. 1-3, the roof decking system 82 as defined by the subject invention provides an improved method of covering and sealing roof decking 114 such as sheets of plywood of the structure prior to applying additional façade or other cosmetic coverings such as shingles, metal, et cetera. A watertight tape seal 116 applied over seams 118 at mating edges of roof decking 114 helps to provide a watertight seal. The roof decking system 82 provides an improved fastening means via nails and/or screws and/or a specific patterned array application of the fasteners so as to securely retain the decking 114 attached to the rafters and/or joist structure.

Figure 9:
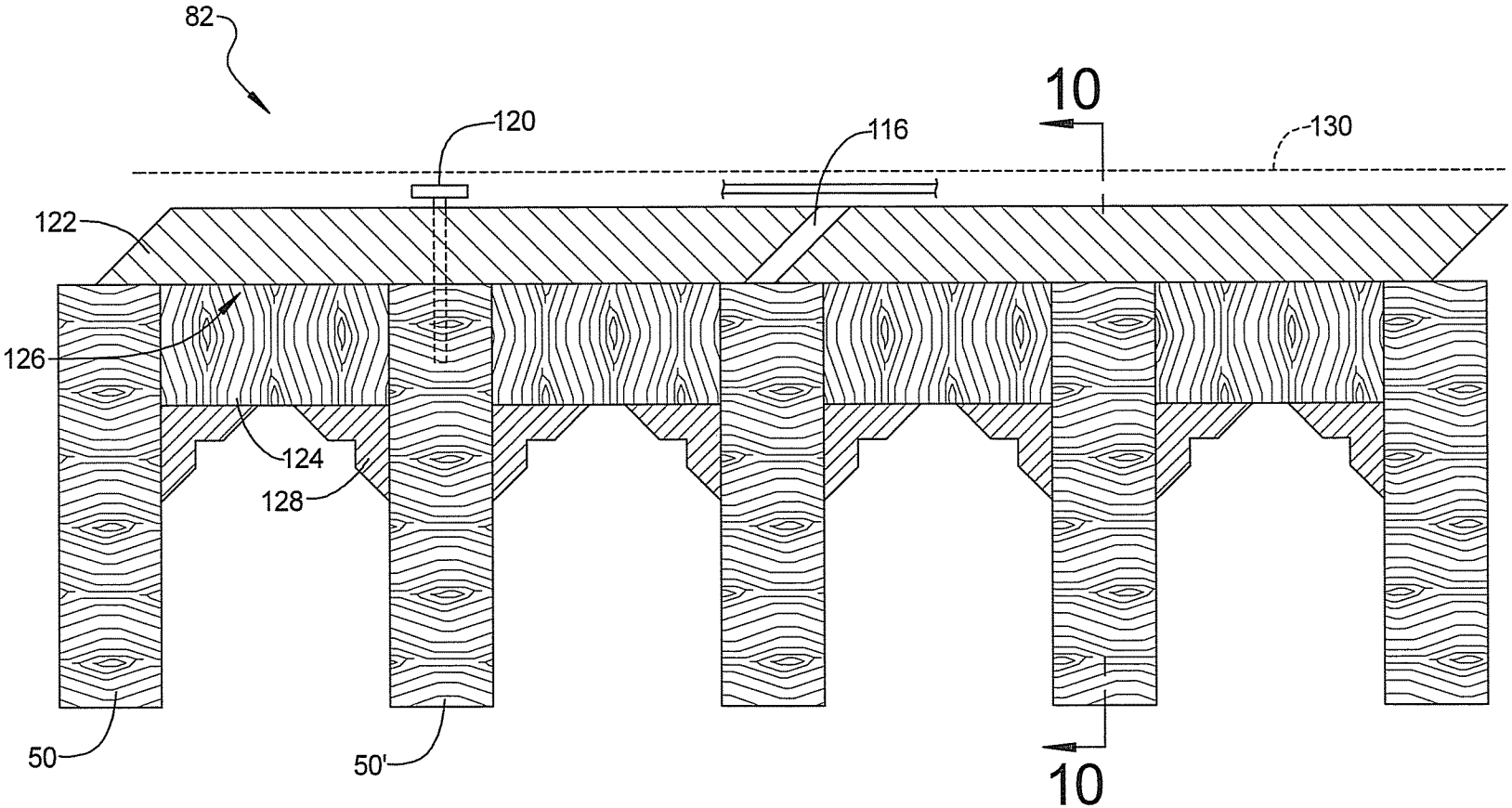
FIG. 9 is a front elevational view of the roof decking system of FIG. 8.

Referring to FIG. 9 and again to FIGS. 1-3 and 8, according to one preferred embodiment of the subject invention, a specialized fastener 120 has a relatively large head and specialized retention features so as to provide improved retention of the decking to the rafters and/or joist. Another preferred embodiment of the subject invention features the decking 114 to be tongue & grooved so as to provide a watertight seal via interlaced edges of the decking. A further preferred embodiment of the decking 114 features a shiplap edge 122 which presents a watertight sealed edge on a bias cut. Yet another preferred embodiment of the decking includes lineup blocking 124 between adjacent rafters 50, 50' and located under the edges 126 of adjacent decking 114 so as to provide a secure fastening surface for the entire edge 126 of the decking 114. The lineup blocking 124 also provides an effective sealing surface under the edge of adjacent sheets of decking 114 and prevents relative deflection at the mating edges of adjacent sheets of decking. The lineup blocking 124 also provides proper alignment and spacing between rafters 50, 50' while at the same time providing resistance to torsion and rhombus forces acting on the rafters and joist. The lineup blocking 124 also defines a continuous line of compression blocks installed between juxtaposed rafters and/or joist to prevent lateral collapse of the structure.

One preferred embodiment of the lineup blocking 124 features a bracket 128 which can be either preassembled to the ends of the lineup block 124 or installed after the lineup block 124 is installed. The bracket 128 provides additional ease of assembly and additional structural integrity to the rafters 50 and decking 114. Another preferred application of the subject invention employs the respective features of a watertight membrane 130 placed over the decking 114 and/or the watertight seal tape 116 covering over the mating edges of adjacent sheets of decking 114, including ridges and valleys.

Referring to FIG. 9 and again to FIGS. 1-8, a cross section through one preferred embodiment of the roof decking system 82 shows shiplap edges, lineup blocks 124, lineup block brackets 128, decking fasteners 120, tape-seals 116 at joints, and the watertight membrane 130. The roof decking system 82 provides a secondary water seal for the roof to resist rain and blowing rain in the event that the primary covering and weather seal façade is compromised and/or lost during storm winds subjected upon the structure. The subject invention effectively unitizes the entire roof construction by employing the roof decking system 82 to cooperate and integrate with the respective features of the wall reinforcement system 34, the wind beam system 80, the rafter/joist tie-down system 66, the roof decking system 82, the venting system 84, the diaphragm reinforcement system 70, and/or the safe room system 72.

Figure 10:
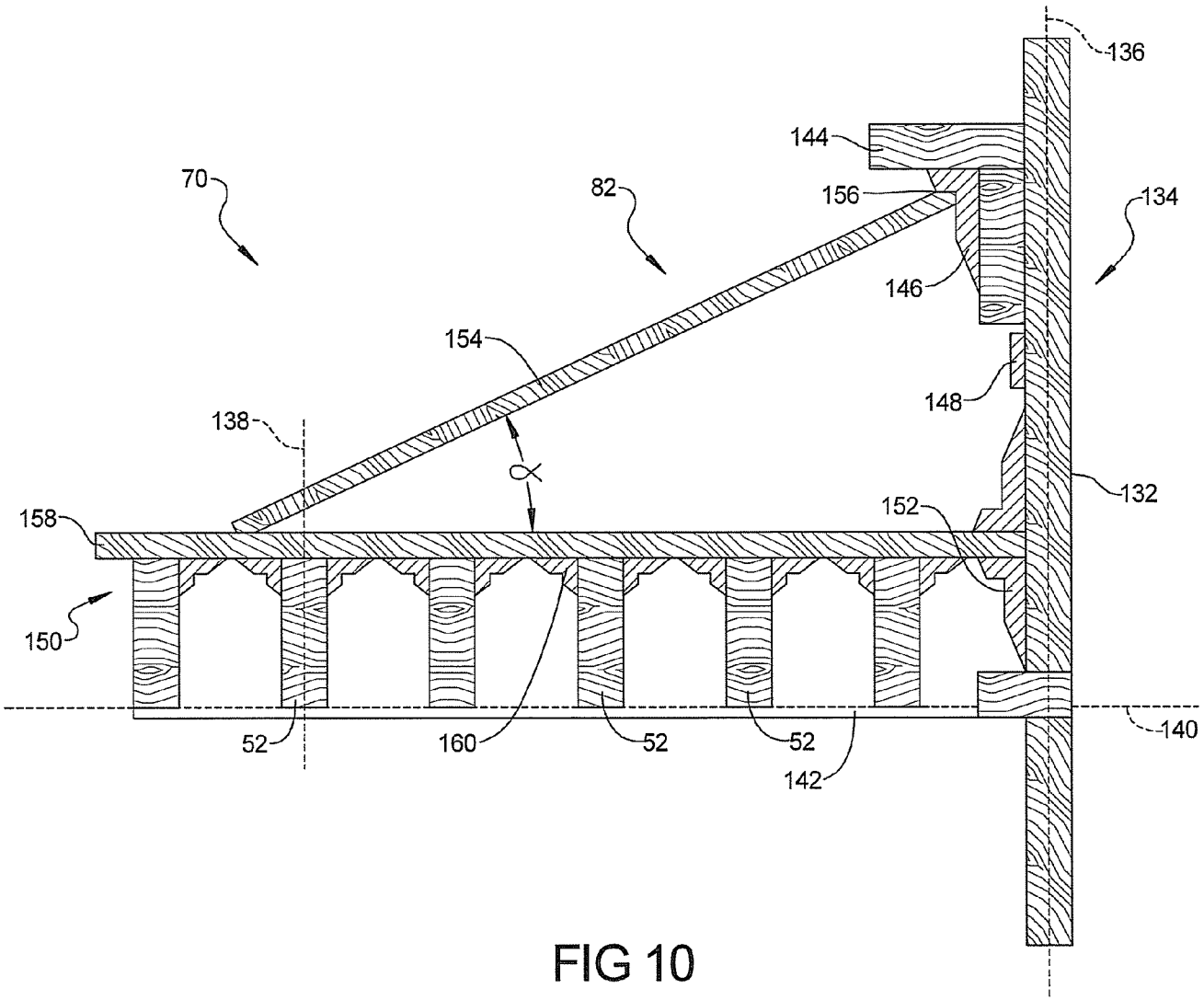
FIG. 10 is a cross sectional end elevational view taken at section 10 of FIG. 9.

Referring to FIG. 10, the diaphragm reinforcement system 70 as defined by the subject invention addresses several diaphragm problems commonly associated with residential and commercial construction. One common diaphragm problem is gable ends of construction wherein, for instance, a triangle shaped wall gable end 132 is formed enclosing one end of a roof system 134. The gable end 132 forms a gable end plane 136 inside the triangle frame of the gable end 132 which is susceptible to being either blown in or sucked out in response to storm winds. Another common diaphragm problem is a joist plane 138 formed by any one of several rafter/joist/truss components, such as joists 52 shown, juxtaposed in array adjacent to the gable end 132 of the roof construction. The joist plane 138 is susceptible to being warped and/or wrenched and/or twisted and/or laterally shifted in response to storm wind forces. Yet another common diaphragm problem is a ceiling plane 140 formed by a ceiling 142 on the underside of the juxtaposed array of joists 52. The ceiling plane 140 is susceptible to warping and flexing due to the joist plane 138 responding to storm winds acting on the structure.

The subject invention overcomes the problems associated with these diaphragms by employing the diaphragm reinforcement system 70. One preferred embodiment of the diaphragm reinforcement system 70 features a pearling brace 144 spanning transverse across the gable end 132. The pearling brace 144 in one preferred embodiment provides a series of specialized brackets 146 which cooperate with standard wood components to enhance the structural integrity of the gable end plane 136. In another preferred pearling embodiment, a structural metal beam 148 and associated brackets span transversely across the gable end 132 to enhance the structural integrity of the gable end plane 136. Another preferred embodiment of the diaphragm reinforcement system 70 features a series of joist brace elements 150 spanning transversely across the array of juxtaposed joists 52 so as to enhance the structural integrity of the joist array to prevent them from being negatively affected by storm force winds.

The joist brace elements 150 are firmly affixed to the joist 52 such that the joist 52 is not only prevented from suffering detrimental joist plane 138 deformation but also preventing detrimental ceiling plane 140 deformation. The joist brace elements 150 are firmly anchored to specialized gable end brackets 152 at the gable end 132 which in turn are directly anchored to the wall reinforcement system 34 components, which in turn anchor the entire construction to the foundation elements. The joist brace elements 150 also include strut elements 154 attaching at one end to the joist brace elements 150 and then spanning at a bias angle α up to a connection point 156 on the pearling brace 144. The strut 154 forms the hypotenuse of a triangle comprised of the strut 154, the gable end plane 136, and a joist brace 158 element, which subsequently forms an enhanced structural means to impart structural integrity to the diaphragms aforementioned which were previously unattainable prior to the subject invention. One or more joist brace brackets 160 which connect the joist brace 158 to the joists 52 also define members of the joist brace elements 150.

With continuing reference to FIG. 10, the gable end plane 136, the ceiling plane 140, and the joist plane 138 are simultaneously structurally enhanced via the collective features of the gable end bracket 152, the joist brace bracket 160, the joist brace 158, the strut 154, and the pearling brace 144. As a result, the entire set of diaphragms are effectively unitized together and integrated into a larger unitized system of structural integrity to maintain a watertight seal system for the construction when subjected to storm wind forces. The subject invention effectively unitizes the diaphragm reinforcement system 70 by employing and integrating the respective features of the anchoring system 10, the wall reinforcement system 34, the rafter/joist tie-down system 66, the wind-beam system 80, the wall sheeting system 68, the venting system 84, and/or the safe room system 72.

Figure 11:
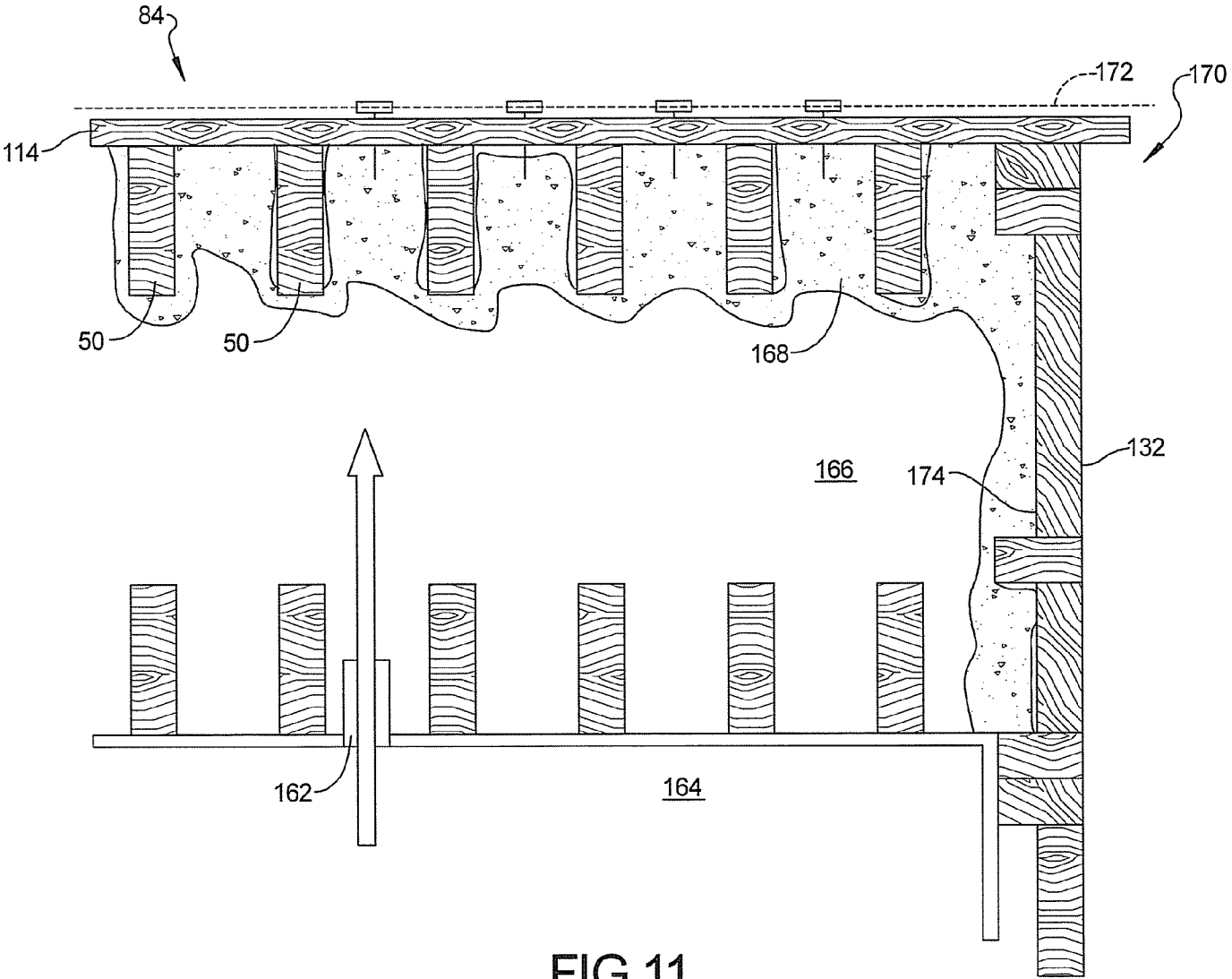
FIG. 11 is a cross sectional end elevational view modified from FIG. 10 to show a venting system.

Referring to FIG. 11, according to one preferred embodiment of the venting system 84, an internal access vent 162 enables air to pass from the conditioned air space defining a living portion 164 of the structure and slightly conditions the air in a roof space 166, wherein a closed cell spray foam 168 insulates and seals the entire underside of a roof system 170 and gable ends 132 to prevent water leaks. The venting system 84 as defined by the subject invention provides a solution for maintaining appropriate thermal conditions for the air in the roof space 166 of a structure so that appropriate air changes and/or conditioning occur in the roof space 166. Typical venting methods include a series of external access vents, such as under eve soffit vents, gable vents, ridge vents, turbines, and louvers, many of which come in passive or powered variations.

A significant problem that basically all known external access venting systems suffer is that they are susceptible to being damaged and/or completely removed during blowing rain in wind storm conditions, which lead to water leaks and subsequent damage. Another significant problem that basically all prior art external access venting systems suffer is that, even if they manage to stay intact during the wind storm conditions, they are further susceptible to allowing blowing rain in wind storm conditions to pass through them and into the roof space, which leads to water leaks and subsequent damage. Therefore, one preferred embodiment of the venting system 84 of the subject invention provides specialized external venting devices for influent and effluent air handling which are able to remain firmly and functionally intact and at the same time control and mitigate blowing rain during wind storm conditions such that water is channeled and/or redirected and/or drained back out of the structure, preventing damaging accumulation inside the structure.

Another preferred embodiment of the subject invention eliminates all external access vents so as to eliminate the problems with any such locations and/or associated venting devices, and replaces them with the small, appropriately sized internal access vents 162 directly connecting the conditioned portion of the structure to the roof space to slightly "condition" the air in the roof space. There is, therefore, no external access vents communicating between the internal conditioned portion of the building structure to ambient air outside the building structure. The conditioned air in the roof space 166 is both appropriately cooled and/or heated in conjunction with the seasons of the year to maintain a moderate temperature range in the roof space 166. The conditioned air in the roof space 166 is further enabled by having no influent or effluent outside air to influence the roof space 166; however, an efficient insulation sealing system, such as the closed cell spray foam 168, is applied to the entire underside of the roof construction to fill in between the rafters 50 to provide an air and water seal to prevent air and water from penetrating the roof construction into the roof space 166. The closed cell spray foam 168 insulation also covers and seals any fasteners of the decking 114 or shingles 172 or other exterior construction that might have penetrated through the decking 114 and into the roof space 166, such that any chance of becoming a future leak path is prevented. The closed cell spray foam 168 insulation also covers walls 174 of the gable ends 132 in the same manner. The subject invention effectively cooperates with a unitized roof construction by employing the venting system 84 to cooperate and integrate with the respective features of the roof decking system 82, the wind beam system 80, the rafter/joist tie-down system 66, and the diaphragm reinforcement system 70.

Figure 12:
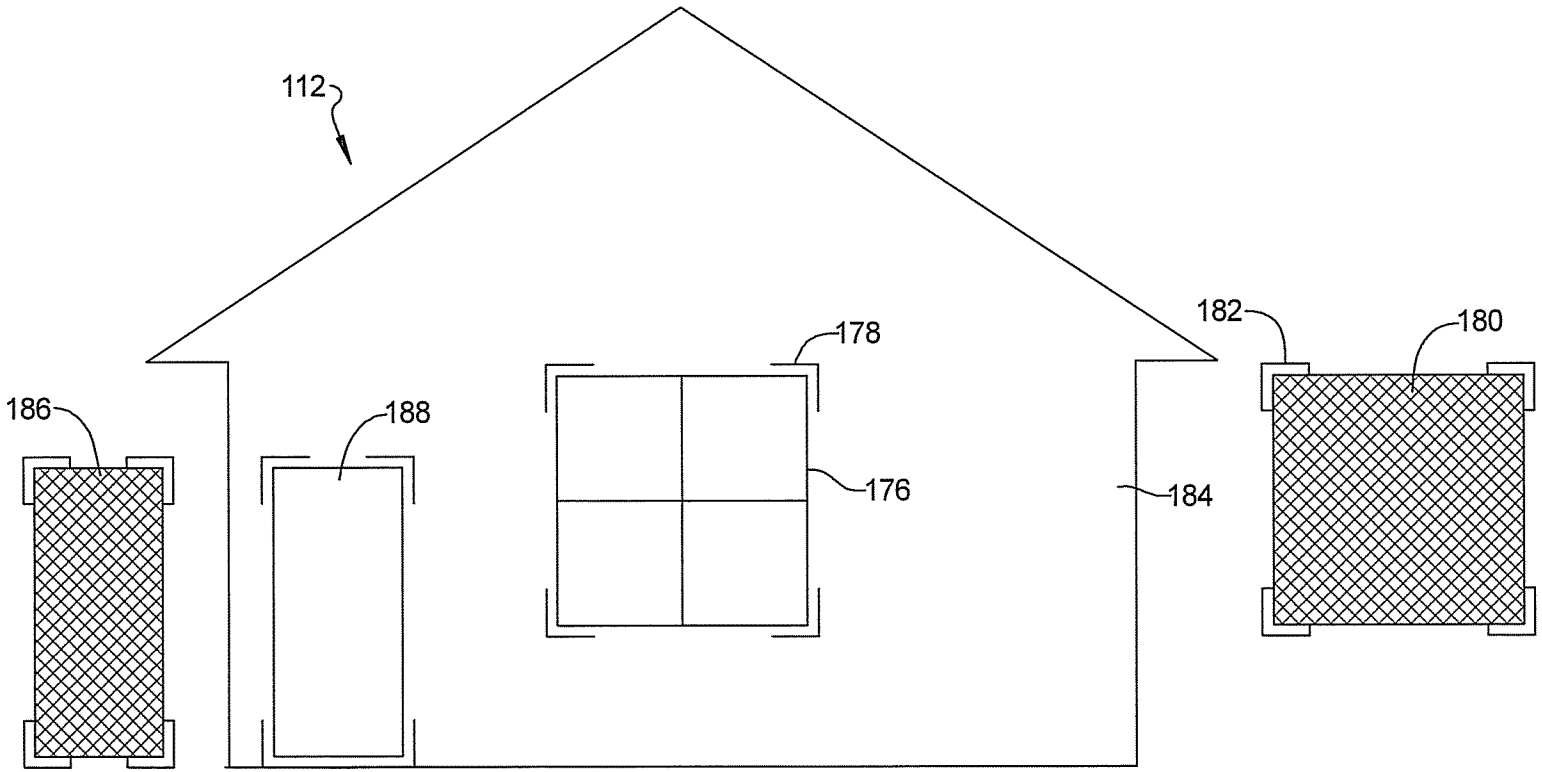
FIG. 12 is a front elevational schematic view of a building window/door protective seal system.

Referring to FIG. 12, one preferred embodiment of the window/door protective system 112 provides for a typical widow 176 for residential structures which is fitted with installed decorative cover mounts 178 such that a removable protective cover 180 securely fastens to the cover mounts 178. The window/door protective system 112 as defined by the subject invention provides the protective cover 180 over windows 176 to minimize the likelihood of breakage during wind storms. One preferred embodiment of the window/door protective system 112 is comprised of a series of brackets 182 and mounting hardware designed to securely establish a robust attachment to the structure 184 and receives an appropriate protective cover 180 designed to fit into and cooperate with the mounted protective cover brackets 182. The protective covers 180 can be stored until required to prepare for an oncoming wind storm. The mounted brackets 182 will remain mounted to the structure 184 and designed to be reasonably decorative. Another preferred embodiment of the subject invention features a similar protective cover 186 over doors 188 and/or installed inside of exterior doors to prevent them from blowing in or being sucked outward during storm winds. Another preferred embodiment of the subject invention features a protective cover over garage doors (not shown) to prevent them from blowing in or being sucked outward during storm winds. The subject invention employs the window/door protective system 112 to cooperate and integrate with the respective features of the wall reinforcement system 34 and/or the safe room system 72.

Figure 13:
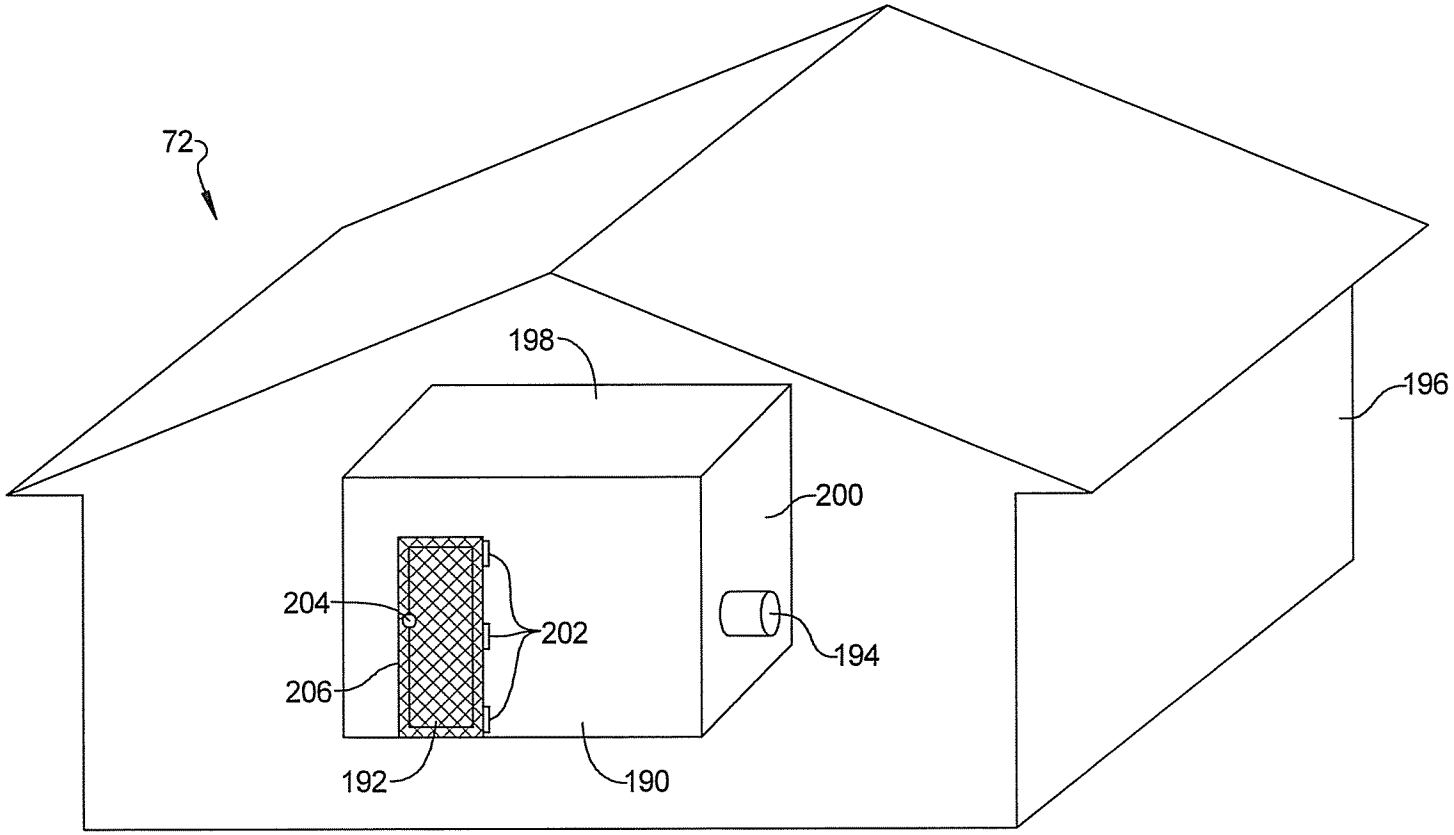
FIG. 13 is a front left perspective view of the building of FIG. 12 modified to include an interior storm safe room.

Referring to FIG. 13, a preferred embodiment of the storm safe room 72 provides an independent unitized room 190 constructed and fitted with a storm door 192 and an air vent 194 positioned inside the building structure. Another preferred embodiment of the subject invention features a storm safe room system 72 which is prefabricated from appropriate enhanced components and delivered to the construction site, and then installed so the building 196 can be constructed around it. The storm safe room system 72 as defined by the subject invention provides enhanced construction components for a self-contained storm safe room which is firmly and strongly anchored to the foundation and/or slab of the structure. The enhanced construction components include those featured in the wall reinforcement system 34, the anchor system 10, the rafter-joist tie-down system 66, the wind beam system 80, door/window protective seal system 112, and/or the roof decking system 82, all combined together to establish a unitized structure to function as an appropriate storm safe room system 72.

Another preferred embodiment of the storm safe room system 72 includes an independent unitized roof 198, reinforced walls 200, and the storm door 192 which opens inward. The door features enhanced hinges 202 and locking and security components 204 to ensure closure in the event it is subjected to storm force winds, flying debris, and/or influent water. The storm safe room system 72 provides the independent fresh air vent 194 and the reinforced door 192 to prevent it from opening except at the command of the occupant and provides a watertight seal 206 to prevent influent water. The storm safe room system 72 provides a storm room suitable of being used as a dual purpose room, such as a closet, pantry, bathroom, or the like. One preferred embodiment of the subject invention features a storm safe room system 72 constructed on-site using appropriate enhanced components.

The subject invention effectively establishes a unitized storm safe room system 72 by cooperating and integrating with the respective features of the anchor system 10, the wall reinforcement system 34, the rafter/joist tie-down system 66, the window/door protective seal system 112, the roof decking system 82, the venting system 84, the wind-beam system 80, the diaphragm reinforcement system 70, and the wall sheeting system 68.

Figure 14:
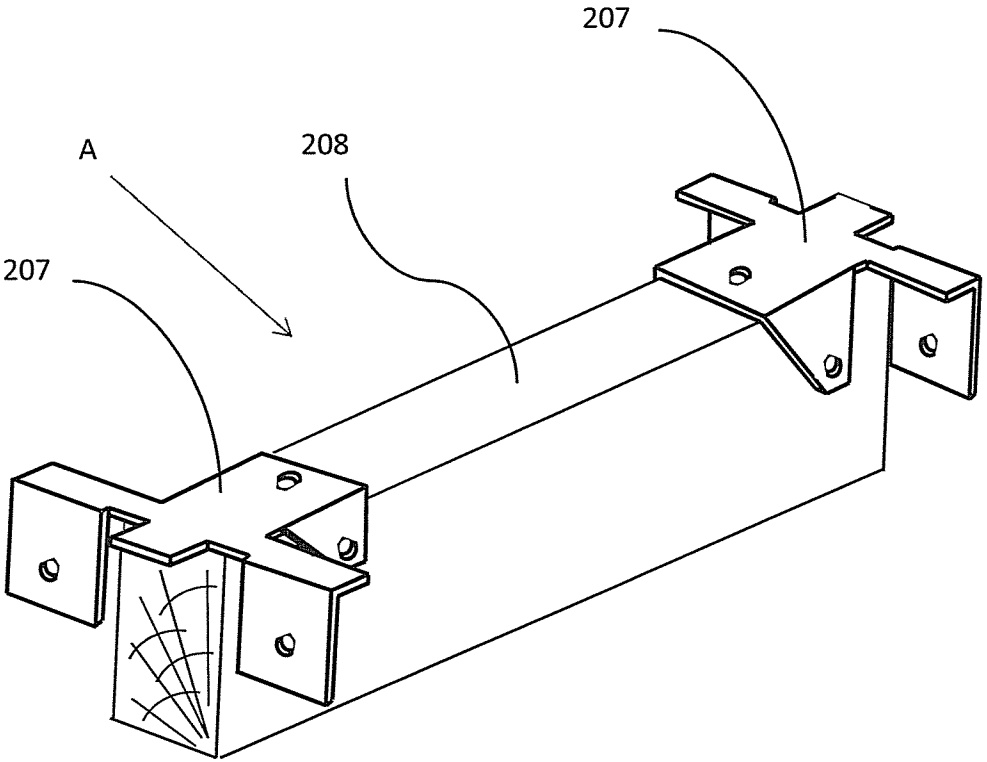
FIG. 14 is a front left perspective view of a blocking brace subassembly used to establish a line of compression blocking in a roof system or wall system.

Referring to FIG. 14, at least a first blocking brace bracket 207 and according to several aspects first and second blocking brace brackets 207 are connected to a blocking brace 208 to form a blocking brace subassembly "A". Multiple subassemblies "A" are used to establish a line of compression blocking on roof and/or wall systems as best seen in reference to FIG. 15. Each subassembly "A" is bolted into place to provide improved structural strength effectively unitizing the frame-type construction elements of the roof and/or wall system. The present disclosure incorporates a line of compression blocking in combination with the other structural enhancements to effectively unitize the entire frame-type construction elements of the building to resist the destructive forces associated with wind and/or seismic events.

Referring to FIG. 15 and again to FIG. 14, a partial view of a line of compression blocking includes multiple subassemblies "A" comprised of blocking braces 208 and blocking brace brackets 207 fastened to roof elements 209. Two brackets 207 which are installed juxtaposed on either side of a roof element 209 are bolted together through roof element 209 establishing a strong continuous line of compression blocking. Each bracket 207 features fastening holes straddling each side of blocking brace 208 which provide stable resistance to torsion and/or seismic forces imposed upon the roof system.

Figure 15:
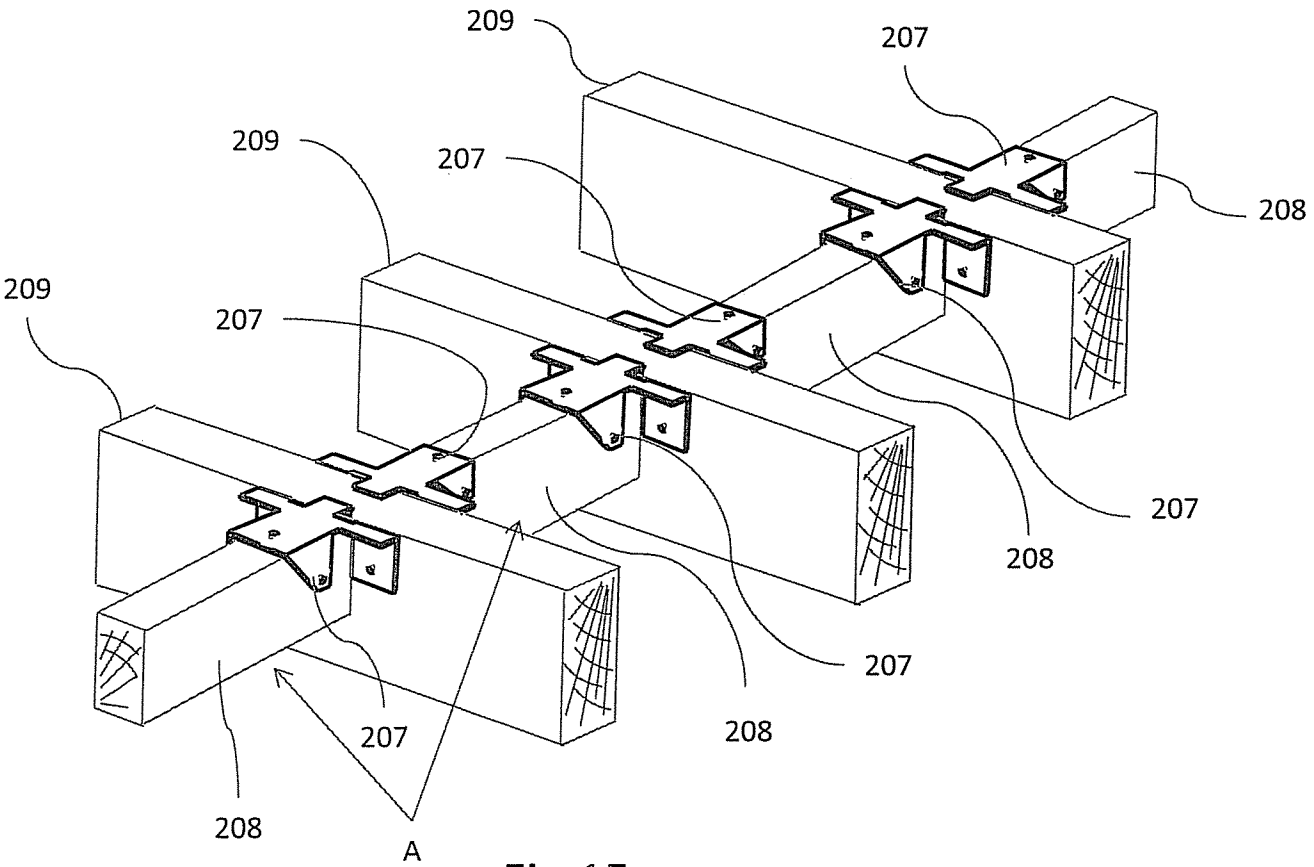
FIG. 15 is a front left perspective view of a line of compression blocking having multiple blocking brace subassemblies of FIG. 14.
Figure 16:
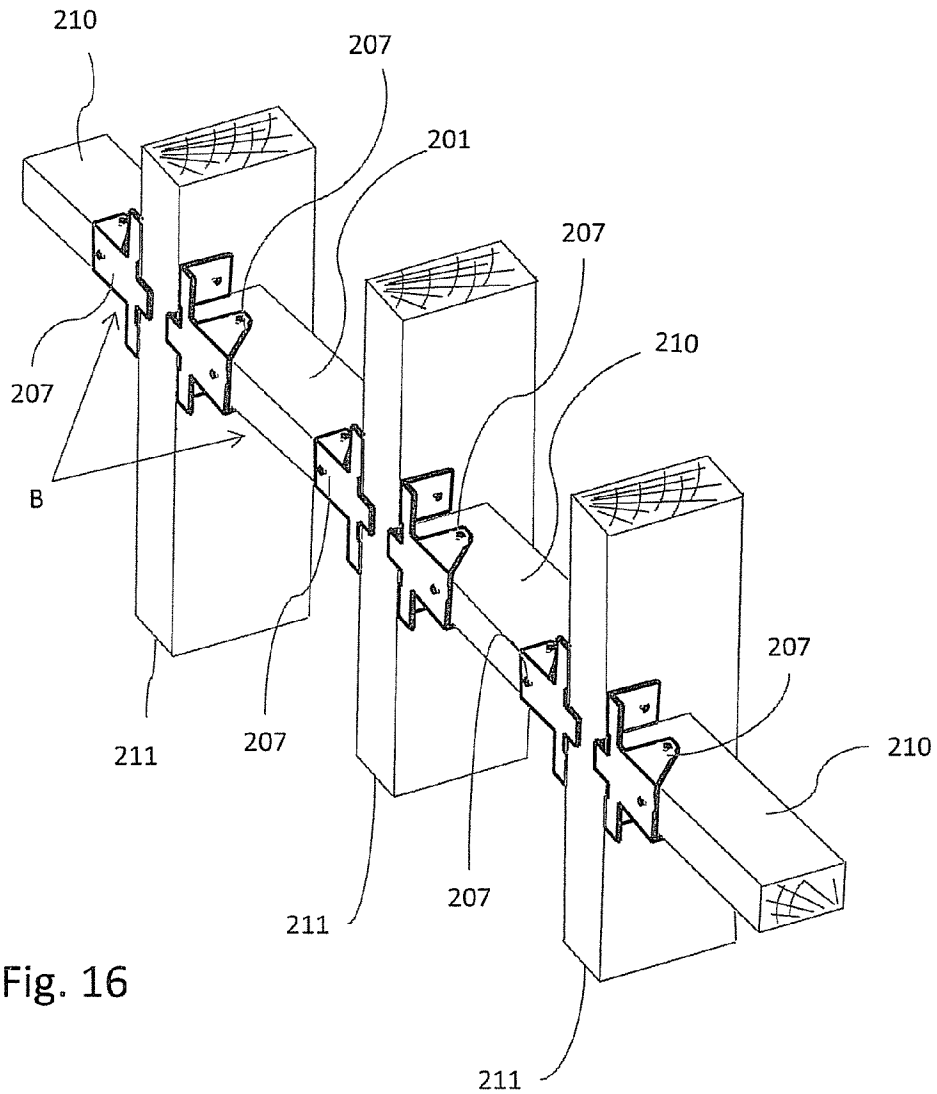
FIG. 16 is a front elevational perspective view of a line of compression blocking applied to a wall system comprised of blocking brace subassemblies similar to FIG. 14.

Referring to FIG. 16 and again to FIGS. 14-15, a partial view of a line of compression blocking includes multiple subassemblies "B" similar to subassemblies "A" which are comprised of blocking braces 210 and blocking brace brackets 207 fastened to wall elements 211. Two brackets 207 which are installed juxtaposed on either side of a wall element 211 are bolted together through wall element 211 establishing a strong continuous line of compression blocking. Each bracket 207 features fastening holes straddle each side of the blocking brace 210 which provide stable resistance to torsion and/or seismic forces imposed upon the roof system.

Figure 17:
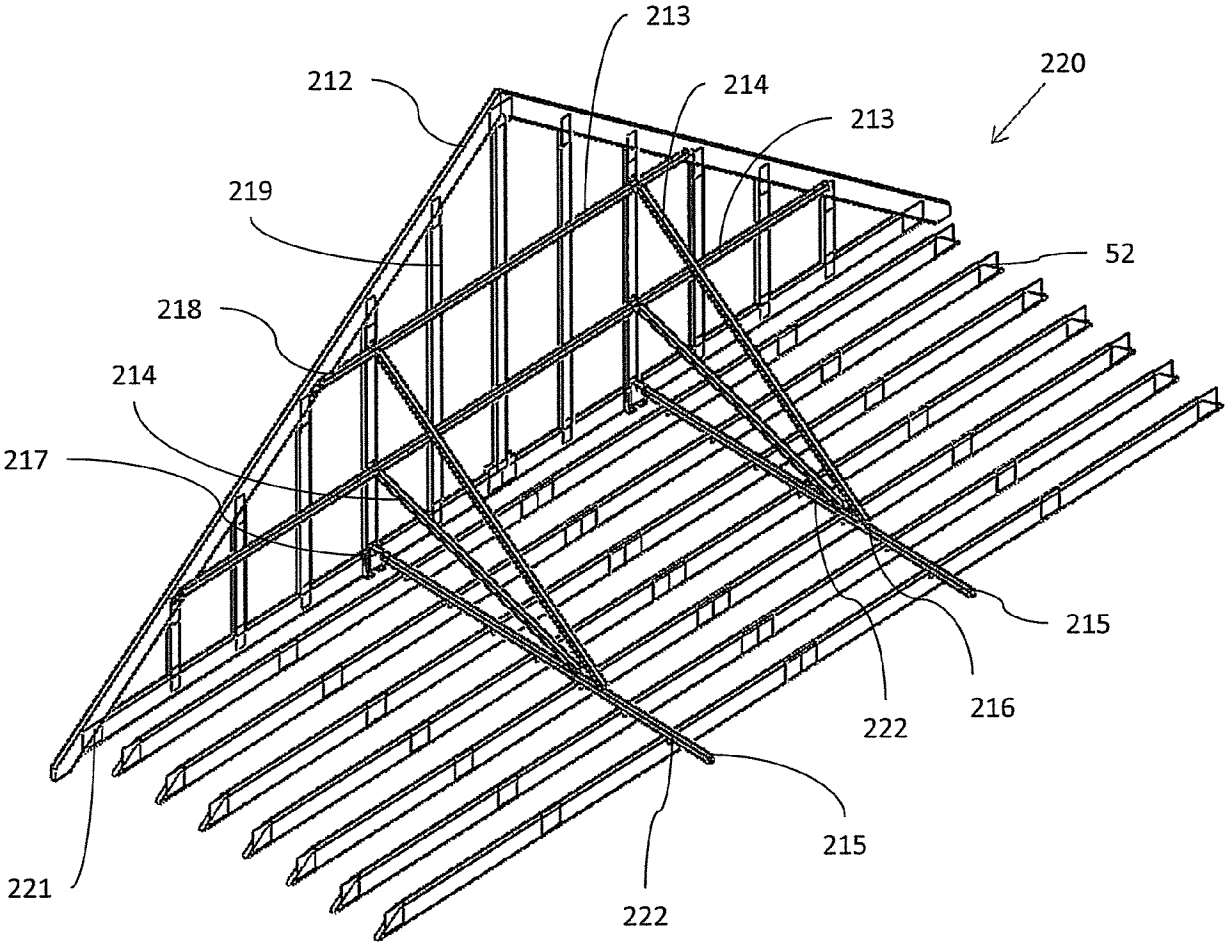
FIG. 17 is a top perspective view of a gable-end of a roof system braced against a ceiling joist and roof system construction elements.

Referring to FIG. 17 a partial view of a typical frame-type building includes a diaphragm enhancement system 220 assembled on a large gable-end truss 212 and braced against vertical studs 219 and joist elements 52. The diaphragm enhancement system 220 includes at least one horizontal prefabricated brace 213 attached to studs 219 along its length, and attached at each end 218 to truss 212. Brace 213 and supported by at least one angled prefabricated brace 214, which is attached to at least one lateral prefabricated brace 215 with double-clevis attachment bracket 216. When large gable-end truss constructions are installed, they require additional structural enhancement to resist destructive forces, such that at least one and according to several aspects multiple additional horizontal prefabricated braces 213 are provided as necessary which are attached to vertical studs 219. Horizontal prefabricated braces 213 are supported by at least one additional angled prefabricated brace 214, which is attached to lateral prefabricated braces 215 using double-clevis attachment brackets 216.

Lateral brace 215 is fitted with single-clevis attachment brackets 222 positioned to cooperate with joist elements 52 so as to establish and maintain parallel spacing of joist elements 52. When wind and torsion forces are imposed upon a frame type construction, the joists 52 are susceptible to flexing and shifting out of position. As a result, sheeting such as sheetrock attached to the interior room side of joist 52 can be compromised and damaged. The present disclosure provides improved structural integrity for joists 52 by maintaining parallel position and resisting shifting movement of joists 52 in response to wind and torsion forces, while also preventing a plane of the ceiling from being compromised.

Prefabricated horizontal brace 213 is bolted to vertical studs 219 along its length and bolted at ends 218 to truss 212. This bolted system effectively unitizes the entire gable-end truss thereby resisting wind and torsion forces imposed upon it, as well as preventing a plane of the gable from being blown in or sucked out. A first angled prefabricated brace 214 is attached to prefabricated lateral brace 215 using a double-clevis bracket 126. In large gable installations, a second or third bracing system may be required to adequately resist damaging forces. In such installations, a second prefabricated angle brace 214 can be attached to either the prefabricated lateral brace 215 or to a first installed angle brace 214 by using double-clevis attachment bracket 216. Enhanced diaphragm enhancement system 220 includes a fastening point where prefabricated lateral brace 215 is fastened to bottom chord of truss 212 using a specialized anti-hinge bracket 217.

Referring to FIG. 18 and again to FIG. 17, connections of enhanced diaphragm system 220 include joist elements 52 which are spaced parallel and maintain position via single-clevis attachment brackets 222 which fasten joists 52 to prefabricated lateral braces 215. Double-clevis attachment brackets 216 fasten prefabricated angled braces 214 to prefabricated lateral braces 215. A second prefabricated angle brace 214 can be fastened to a first angle brace 214 or fastened to lateral brace 215 using double-clevis attachment bracket 216. Double-clevis attachment bracket 216 is able to slide along lateral brace 215 and/or angled brace 214 so that proper support can be field cut and installed by field drilling appropriate bolting holes in braces 214 or 215. Attachment holes pre-drilled in double-clevis bracket 216 act as drill guides to save time measuring and locating the position of mounting holes through lateral brace 215 or angled brace 214.

An anti-hinge bracket 217 is fastened to prefabricated lateral brace 215 and bolted in multiple locations to bottom truss chord 221. Mounting holes in anti-hinge bracket 217 are positioned straddling lateral brace 215 which provide improved enhancement strength and structural integrity for the gable-end truss to prevent the truss from collapsing and/or being sucked out from wind and/or torsion forces. Additional mounting holes in anti-hinge bracket 217 cooperate and align with anti-torsion tension-compression columns by bolting down through the double top plate 44 with fasteners 236 and bolting directly to the structural columns 18, which tie directly to foundational elements. In traditional gable-end truss construction, destructive forces can collapse a gable-end truss by effectively hinging it over where the bottom chord 221 mates with double top plate 44. The present disclosure overcomes this problem by combining the unitized benefits and support of enhanced diaphragm system 220 which includes at least one anti-hinge bracket 217.

Figure 19:
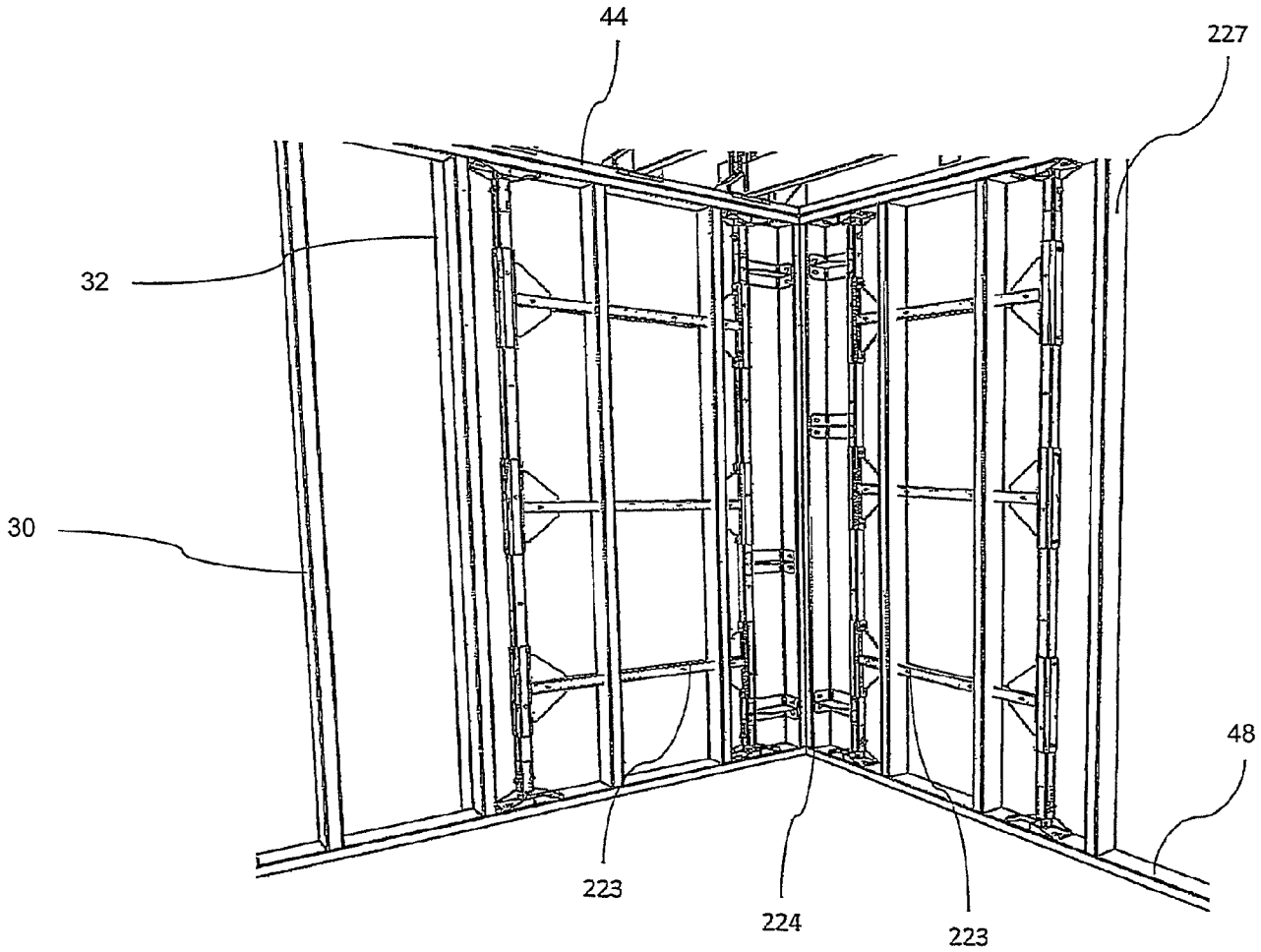
FIG. 19 is a side elevational perspective view of an inside corner of a wall system featuring a lateral corner brace enhancement assembly.

Referring to FIG. 19 an inside corner of a typical frame-type construction includes a corner 224 positioned between two intersecting walls comprised of multiple studs 30, 32, a bottom plate 48, and a double top plate 44. A lateral corner brace subassembly 223 is installed on each side of corner 224 and fastened to studs 30, 32, fastened down through bottom plate 48 to foundation anchors, fastened up through the double top plate 44 to roof elements, and fastened to corner 224. This configuration effectively unitizes the entire corner portion of the building to resist damaging wind and torsion forces imposed by storms and seismic events. The present disclosure provides enhanced structural integrity throughout the entire structure by combining the features and benefits of many structural improvements such as lateral corner brace subassemblies 223.

Lateral corner brace subassemblies 223 are appropriately installed straddling building corners as shown in FIG. 19 wherein two subassemblies 223 are used. Installations where an interior wall intersects an exterior wall may require three subassemblies 223, wherein two of the subassemblies 223 will be oriented along the exterior wall straddling the intersecting corner, and one subassembly will be oriented transverse along the interior wall. All three of the subassemblies 223 will be fastened to the intersecting corner, which will provide substantially enhanced structural integrity to the building to resist damaging winds and/or torsion forces imposed by storm and/or seismic events.

Figure 18:
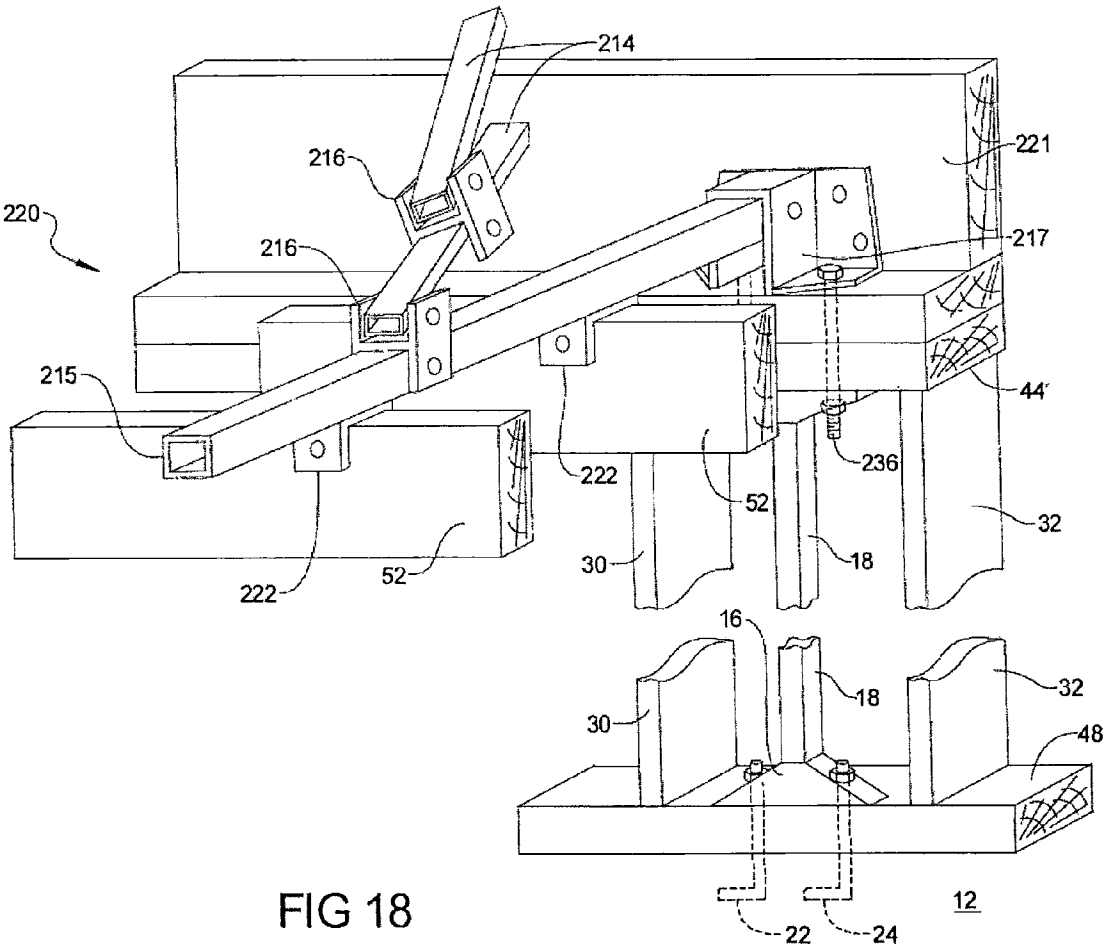
FIG. 18 is a an end elevational perspective view of an improved diaphragm system.
Figure 20:
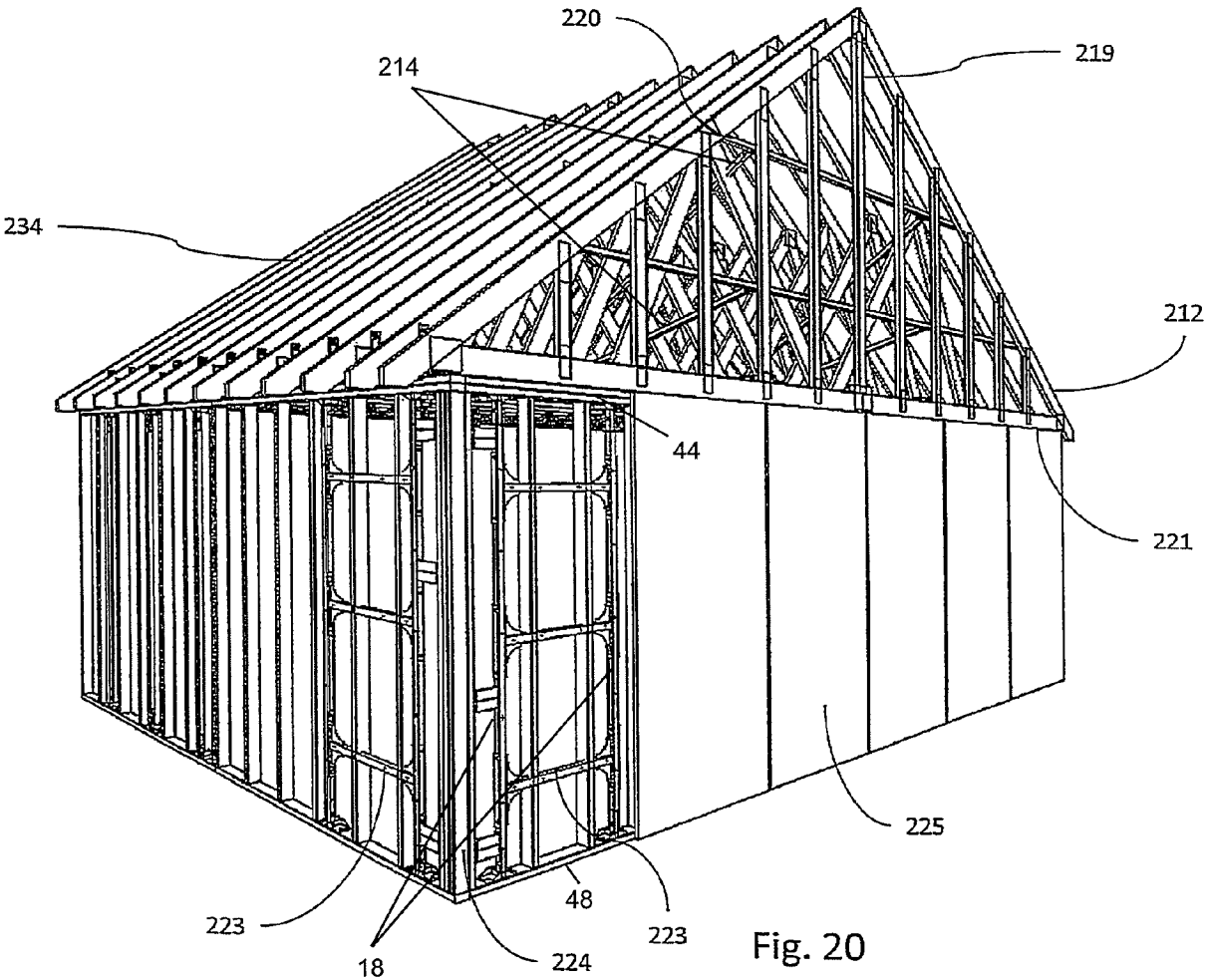
FIG. 20 is a side elevational perspective view looking from the outside in through a corner of a wall construction having a lateral corner brace enhancement assembly and a diaphragm system applied to the roof system.

Referring to FIG. 20 and again to FIGS. 17-19, a typical frame-type construction has a corner 224 installed with two lateral corner brace subassemblies 223 oriented along each of the intersecting walls joined at corner 224. Gable-end truss 212 is installed with a bottom chord 221 connected to the double top plate 44 of the wall construction. Wall sheeting 225 is fastened to studs 30, 32 in the wall construction. Prefabricated trusses 234 are installed in a line juxtaposed next to gable-end truss 212. The present disclosure improves the structural integrity of wall sheeting by providing fastening points between the wall sheeting and subassemblies 223. The present disclosure further enhances the gable-end truss 212 by providing a bolted connection from subassembly 223 up through the double top plate 44 of the wall to connect to anti-hinge bracket 217 (not shown) which is bolted to bottom truss chord 221, and bolted to the diaphragm enhancement system 220. A line of compression blocking (as shown in FIG. 15) is installed in trusses 234. Subassemblies 223 are bolted to the corner 224, bolted to the roof elements which are bolted to the trusses 234, bolted to the diaphragm enhancement system 220, fastened to the wall sheeting, bolted through the double top plate 44, bolted through the bottom plate 48, and directly anchored to foundational elements, effectively unitizing all of the frame-type construction elements with structural integrity.

Figure 21:
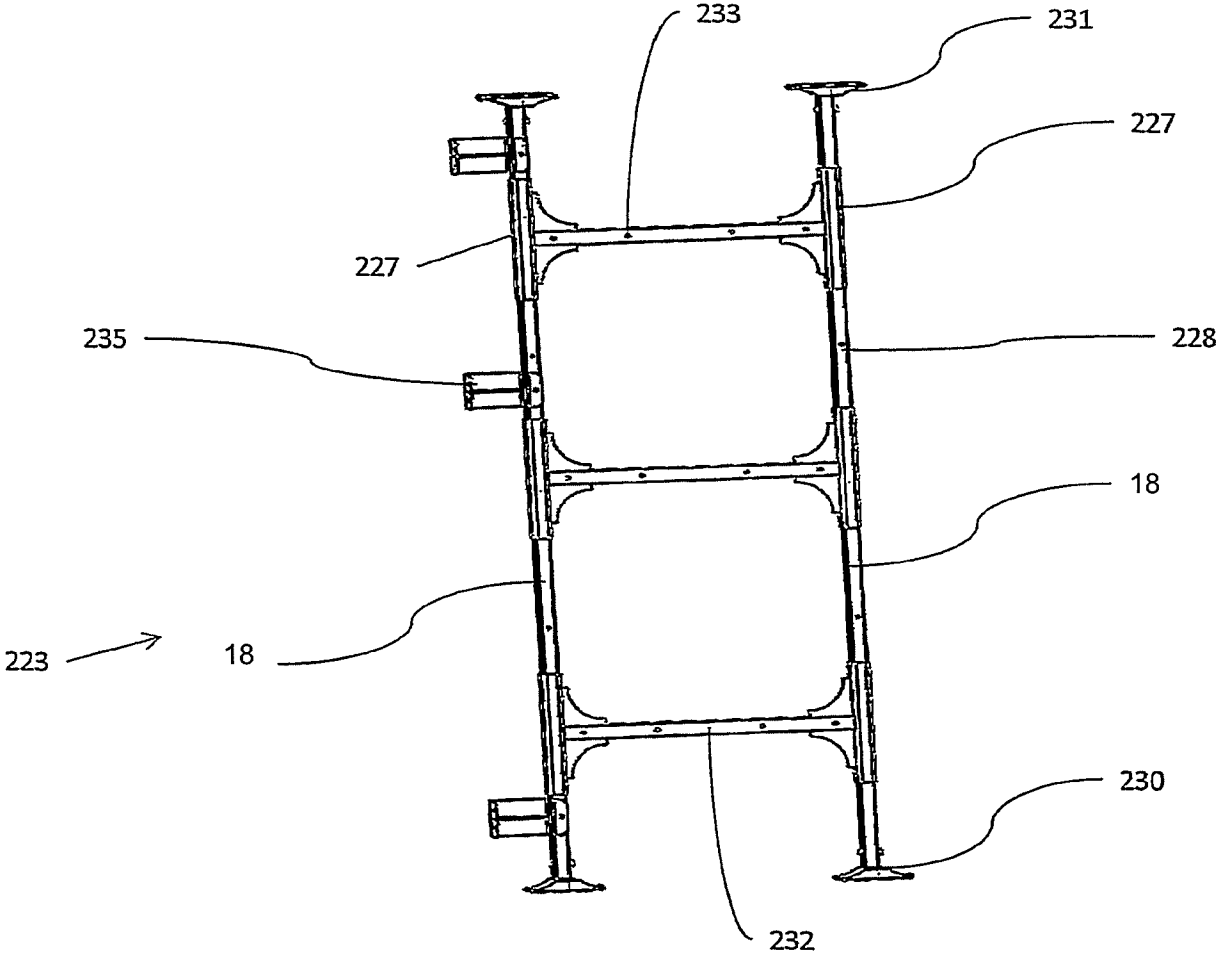
FIG. 21 is a front elevational view of lateral corner brace enhancement subassembly.

Referring to FIG. 21 and again to FIGS. 17-20 each subassembly 223 can comprise at least two specialized anti-torsion tension compression structural columns 18, at least one lateral connecting brace 232, and at least one corner connecting bracket 235. Lateral connecting brace 232 is comprised of a lateral spanner beam 233 assembled between two lateral connecting brackets 227. Lateral spanner beam 233 is predrilled with holes to provide fastening points for wall sheeting. Structural columns 18 are predrilled with fastening holes 228 spaced along the length of the structural column 18 for fastening wall sheeting. Structural columns 18 are also predrilled with holes to assemble lateral connecting brackets 227 and to receive corner connecting brackets 235. The lower end of structural columns 18 are fitted with connecting brackets 230 allowing bolted connections down through the bottom plate 48 to fasten directly to foundational elements. The upper end of structural columns 18 are fitted with connecting brackets 231 to bolt through the double top plate 44 and connect to roof elements.

The present disclosure significantly enhances the structural integrity of a framed construction with the installation of subassemblies 223 at each corner and the diaphragm enhancement assembly 220. In addition to these enhancements, the present disclosure includes the integration and benefits of the anchoring system (not shown) and the line of compression blocking (described in reference to FIGS. 15 and 16) and anti-torsion roof system elements and anti-torsion tension compression columns, all combined together to provide a unitized structural frame-type building capable of resisting substantial wind forces, torsion forces, and/or seismic forces, well above what is possible before the introduction of the subject invention.

The present disclosure further incorporates the benefits of a secondary sealing system to maintain an integral seal in the event that exterior cosmetic and primary sealing systems are compromised during storm events.

The present disclosure further incorporates the features of an entire unitized structural enhancement system to combine with a unitized safe-room to provide maximum protection from the storm events.

The present disclosure provides an improved system for a typical residential or commercial structure wherein a series of specialized components are integrated together so as to enhance the structural integrity of the structure against wind forces, such as those associated with hurricanes and/or tornados, so as to provide a secondary relatively watertight seal for the structure, even in the event that the primary sealing system of shingles and/or siding is compromised, damaged, or removed by the storm winds. As a result, known shingles and siding provide a cosmetic covering and a primary water seal for the structure; however, the present disclosure provides a secondary water seal in the event that the primary seal system is compromised during storm wind exposure.

The present disclosure further provides structural enhancements that can be applied to new construction as well as retrofitting existing structures so as to improve structural integrity and secondary sealing against wind and seismic forces such as those associated with hurricanes and/or tornados. The present disclosure further provides structural enhancements that cooperate with standard construction components so as to improve the structural integrity of the construction components beyond their original capabilities against wind and seismic forces, such as those associated with hurricanes and/or tornados, and further to provide a secondary sealing system to resist influent water in the event that the primary sealing system is compromised.

The typical preferred embodiment construction material for the structural enhanced components of the subject invention is metal. Said components may be manufactured from metal using any one of several typical methods such as stamping, forging, bending, welding, or combinations of fabrication methods. In addition, said components may be manufactured from non-metal materials such as plastic, reinforced plastic, fiberglass, composites, and/or any other appropriate technology materials suitable to provide the strength requirements for a given application.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A construction system providing structural integrity for a building structure to resist the destructive forces of storm winds, torsion forces, and seismic forces, and to minimize or prevent the influent of associated wind-driven blowing rain, comprising:

multiple subsystems connected to the building structure, the building structure including a wall structure having multiple studs and a roof structure including at least one from a group of trusses, joists and rafters, the multiple subsystems including:

an anchoring system connected to a foundation;

a wall reinforcement system having multiple structural columns individually positioned between proximate ones of the studs;

a lateral corner brace reinforcement system having sub-assemblies positioned along intersecting walls and fastened together at a building structure intersecting corner;

a diaphragm reinforcement system having multiple members fastened to gable-ends of the roof structure, fastened to at least one from the group of trusses, joists and rafters of the building structure, and connected to the anchoring system;

a line of compression blocking in the building structure;

a rafter/joist tie-down system having multiple members individually coupling each of the structural columns to the roof structure such that the wall reinforcement system ties together the roof structure and the wall structure to the foundation using the structural columns; and the diaphragm reinforcement system including at least one horizontal support beam fastened across one of the gable-ends of the roof structure, the diaphragm reinforcement system being supported by at least one angled brace connected to at least one lateral brace fastened to at least one from the group of trusses, joists and rafters, and the diaphragm reinforcement system including an anti-hinge bracket fastened to at least one of the structural columns and to a foundational element of the anchoring system.

2. The construction system of claim 1, wherein the subsystems further include a line of compression blocking in the roof structure having aligned bolted connections straddling individual blocking braces.

3. The construction system of claim 2, wherein a roof decking is fastened to the blocking braces.

4. The construction system of claim 1, wherein the subsystems further include a line of compression blocking in the wall system having aligned bolted connections straddling multiple individual blocking braces.

5. The construction system of claim 4, wherein a wall sheeting is fastened to the blocking braces.

6. The construction system of claim 1, wherein the at least one angled brace is attached to at least one lateral brace using a double-clevis bracket.

7. The construction system of claim 6, wherein the double-clevis bracket includes a predrilled hole providing a drill guide for field installation and attachment.

8. The construction system of claim 1, wherein the lateral brace is attached to a joist using a single-clevis bracket.

9. The construction system of claim 1, wherein the anti-hinge bracket includes mounting holes for attachment to a gable-end construction positioned straddling a lateral brace and fastened to the anti-hinge bracket.

10. The construction system of claim 1, wherein the anti-hinge bracket is fastened directly to the gable-end, fastened directly to a double top plate of the wall structure, and fastened directly to the lateral brace of the diaphragm reinforcement system, and further connected to a foundation element of the anchoring system through a structural column in the wall construction.

11. The construction system of claim 1, wherein the subsystems further include a lateral corner brace reinforcement assembly including at least one structural column, at least one lateral spanning beam, and at least one corner connecting bracket.

12. The construction system of claim 11, further including multiple structural columns individually predrilled as fastening points for a wall sheeting.

13. The construction system of claim 11, further including multiple lateral beams individually predrilled as fastening points for a wall sheeting.

14. The construction system of claim 11, wherein the lateral corner brace reinforcement assembly includes at least one corner connecting bracket predrilled to fasten to a corner construction element.

15. The construction system of claim 11, wherein the lateral corner brace reinforcement assembly is fastened directly to multiple corner construction elements, fastened directly to a roof reinforcement element through a double top plate, connected to a foundational element, and fastened directly to a wall sheeting.

16. The construction system of claim 15, wherein the lateral corner brace reinforcement assembly is also fastened to the diaphragm reinforcement system.

17. The construction system of claim 1, wherein the anchoring system includes anchor fasteners connected to and partially extending from the foundation, each structural column connected to two of the anchor fasteners.

18. A construction system providing structural integrity for a building structure including a wall structure having multiple studs, a foundation, and a roof structure including gabled ends and at least one from a group of trusses, joists and rafters, the construction system comprising:

an anchoring system including a foundational element that is connected to the foundation of the building structure;

a wall reinforcement system having multiple structural columns individually positioned between proximate ones of the multiple studs of the building structure; and a diaphragm reinforcement system that is substantially transverse to at least one from the group of trusses, joists and rafters, the diaphragm reinforcement system having multiple members fastened to at least one of the gable-ends of the roof structure, at least one from the group of trusses, joists and rafters of the building structure, and the anchoring system;

wherein the diaphragm reinforcement system includes at least one horizontal support beam fastened to at least one of the gabled-ends of the roof structure, the diaphragm reinforcement system being supported by at least one angled brace connected to at least one lateral brace fastened to at least one from the group of trusses, joists and rafters, the diaphragm reinforcement system including an anti-hinge bracket fastened to the at least one of the gabled-ends of the roof structure and to at least one structural column of the multiple structural columns such that the anti-hinge bracket directly ties the diaphgragm reinforcement system and the at least one of the gabled-ends of the roof structure to the foundational element of the anchoring system via the at least one structural column.

19. The construction system of claim 18, wherein the foundational element of the anchoring system includes anchor fasteners that are connected to and partially extend from the foundation and wherein each structural column of the multiple structural columns is connected to two of the anchor fasteners.

* * * * *